US011319179B2

(12) United States Patent
Nagai

(10) Patent No.: US 11,319,179 B2
(45) **Date of Patent: *May 3, 2022**

(54) TRANSPORTING APPARATUS, FIBROUS FEEDSTOCK RECYCLING APPARATUS, AND TRANSPORTING METHOD

(71) Applicant: SEIKO EPSON CORPORATION, Tokyo (JP)

(72) Inventor: Yoshiyuki Nagai, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 106 days.

This patent is subject to a terminal disclaimer.

(21) Appl. No.: 16/672,593

(22) Filed: Nov. 4, 2019

(65) Prior Publication Data

US 2020/0140220 A1 May 7, 2020

(30) Foreign Application Priority Data

Nov. 5, 2018 (JP) ..... JP2018-207919

(51) Int. Cl.
*B65H 20/02* (2006.01)
*D21G 9/00* (2006.01)
*B65H 26/00* (2006.01)

(52) U.S. Cl.
CPC ..... *B65H 26/00* (2013.01); *B65H 20/02* (2013.01); *D21G 9/0009* (2013.01)

(58) Field of Classification Search
CPC .... B65H 20/00; B65H 23/00; B65H 2220/01; B65H 2220/02; D21F 2/00; D21H 11/14; D21C 5/02; D21B 1/08; D21G 9/0009
See application file for complete search history.

(56) References Cited

U.S. PATENT DOCUMENTS 3,667,664 A * 6/1972 Schroeder ..... B65H 23/044 226/30
4,496,428 A * 1/1985 Wells ..... B65H 23/044 162/256
6,499,639 B2 * 12/2002 Cote ..... B65H 23/1888 226/111
6,659,006 B2 * 12/2003 Brennan ..... B65H 23/038 101/225
8,662,626 B2 * 3/2014 Kahl ..... B65H 23/1888 347/19

FOREIGN PATENT DOCUMENTS

JP 2004-058518 A 2/2004
JP 2016-129998 A 7/2016

* cited by examiner

*Primary Examiner* — Eric Hug
(74) *Attorney, Agent, or Firm* — Oliff PLC

(57) ABSTRACT

A transporting apparatus includes a pressurizing roller that transports a web-like or sheet-like transport target object and a heating roller disposed downstream of the pressurizing roller in a transport path, a first bottom sensor and a first top sensor that are disposed between the pressurizing roller and the heating roller, a measuring section that measures a time from when the transport target object is detected by the first bottom sensor until the transport target object is detected by the first top sensor, and a rotation control section that modifies a rotation speed of the heating roller when a time measured by the measuring section is shorter than a first reference time.

12 Claims, 10 Drawing Sheets

FIG. 5

164

| PRESSURIZING ROLLER SPEED | HEATING ROLLER SPEED | TRANSPORT ROLLER SPEED |
|---|---|---|
| Vp | Vhs | Vc1 |
| | | Vc2 |
| | Vhf | Vc3 |
| | | Vc4 |

TRANSPORTING APPARATUS, FIBROUS FEEDSTOCK RECYCLING APPARATUS, AND TRANSPORTING METHOD

The present application is based on, and claims priority from JP Application Serial Number 2018-207919, filed Nov. 5, 2018, the disclosure of which is hereby incorporated by reference herein in its entirety.

BACKGROUND

1. Technical Field

The present disclosure relates to a transporting apparatus, a fibrous feedstock recycling apparatus, and a transporting method.

2. Related Art

In the related art, there is known an apparatus provided with a transporting mechanism which transports a sheet-like target recording medium using rollers (for example, refer to JP-A-2004-58518). The apparatus described in JP-A-2004-58518 includes a sensor which detects slack in a target recording medium, driving the rollers at a low speed in a state in which slack is not detected in the target recording medium by the sensor, and switching to driving the rollers at a medium speed when slack is detected.

In the configuration described in JP-A-2004-58518, when the speed of the rollers is not appropriately set, changes in the slack in the target recording medium increase in speed and there is a problem in that the target recording medium is not stable during transport.

SUMMARY

According to an aspect of the present disclosure, there is provided a transporting apparatus including a first roller that transports a web-like or sheet-like transport target object and a second roller disposed downstream of the first roller in a transport path of the transport target object, a first detection section and a second detection section that are disposed between the first roller and the second roller in the transport path, the first detection section being provided on one side in the transport path and the second detection section being provided on another side in the transport path, a measuring section that measures a time from when the transport target object is detected by the first detection section until the transport target object is detected by the second detection section, and a rotation control section that modifies a rotation speed of the second roller when the time measured by the measuring section is shorter than a first reference time.

In the transporting apparatus, with respect to a vertical direction, the first detection section may be disposed on one side of the transport path and the second detection section may be installed on an opposite side of the transport path from the first detection section.

The transporting apparatus may further include a moving member disposed between the first roller and the second roller in the transport path, the moving member moving in response to displacement of the transport target object, in which the first detection section may include a first sensor that detects the moving member and the second detection section may include a second sensor that detects the moving member, and the first detection section and the second detection section may detect the transport target object by detecting the moving member.

In the transporting apparatus, the rotation control section may execute stepwise control for modifying, in a stepwise manner, the rotation speed of the second roller and modifies the rotation speed of the second roller by a smaller change amount than in the stepwise control when the time measured by the measuring section is shorter than the first reference time.

In the transporting apparatus, the first detection section may be disposed so as to correspond to a position of the transport target object when a length of the transport target object between the first roller and the second roller is a predetermined length, the second detection section may be disposed so as to correspond to a position of the transport target object when the length of the transport target object between the first roller and the second roller is shorter than the predetermined length, the rotation control section may set the rotation speed of the second roller to a first speed when the transport target object is detected by the first detection section and may set the rotation speed of the second roller to a second speed that is a lower speed than the first speed when the transport target object is detected by the second detection section, and the rotation control section may modify one or both of the first speed and the second speed when the time measured by the measuring section is shorter than the first reference time.

In the transporting apparatus, the measuring section may repeatedly execute measurement of a time required for an operation from when the transport target object is detected by the first detection section until the transport target object is detected by the second detection section, the rotation control section may compare an average value of a set number of measured times that are measured by the measuring section to the first reference time, and the set number may be greater than or equal to 2.

In the transporting apparatus, the rotation control section may be configured to modify the set number.

In the transporting apparatus, the rotation control section may modify the set number based on a number of times an operation of detecting the transport target object by the second detection section after the transport target object is detected by the first detection section is performed in a second reference time.

In the transporting apparatus, the first roller may be a pressurizing roller that pressurizes the transport target object.

According to another aspect of the present disclosure, there is provided a fibrous feedstock recycling apparatus including a forming section that forms a web-like or sheet-like processing target object from a feedstock containing fibers, a processing section that processes the processing target object, and a transport section that transports the processing target object from the forming section to the processing section, in which the transport section includes a first roller that transports the processing target object and a second roller disposed downstream of the first roller in a transport path of the processing target object, a first detection section and a second detection section that are disposed between the first roller and the second roller in the transport path of the processing target object, the first detection section being provided on one side in the transport path and the second detection section being provided on another side in the transport path, a measuring section that measures a time from when the processing target object is detected by the first detection section until the processing target object is detected by the second detection section, and a rotation control section that modifies a rotation speed of the second roller when the time measured by the measuring section is shorter than a first reference time.

In the fibrous feedstock recycling apparatus, the first roller or the second roller may be a pressurizing roller which pressurizes the processing target object, and the roller that is not the pressurizing roller among the first roller and the second roller may be a heating roller which heats the processing target object.

According to still another aspect of the present disclosure, there is provided a transporting method of transporting a web-like or sheet-like transport target object using a first roller which transports the transport target object and a second roller disposed downstream of the first roller in a transport path of the transport target object in which a first detection section and a second detection section are disposed between the first roller and the second roller in the transport path, the first detection section being provided on one side in the transport path and the second detection section being provided on another side in the transport path, the method including a first step of measuring a time from when the transport target object is detected by the first detection section until the transport target object is detected by the second detection section, and a second step of modifying a rotation speed of the second roller when the time measured in the first step is shorter than a first reference time.

BRIEF DESCRIPTION OF THE DRAWINGS

FIG. 5 is a schematic diagram illustrating a configuration example of speed setting values.

DESCRIPTION OF EXEMPLARY EMBODIMENTS

Hereinafter, a detailed description will be given of favorable embodiments of the present disclosure using the drawings. The embodiments described hereinafter are not to be construed as limiting the content of the present disclosure. All of the configurations which are described hereinafter are not necessarily essential constituent elements of the present disclosure.

1. First Embodiment

1-1. Overall Configuration of Sheet Manufacturing Apparatus

Figure 1:
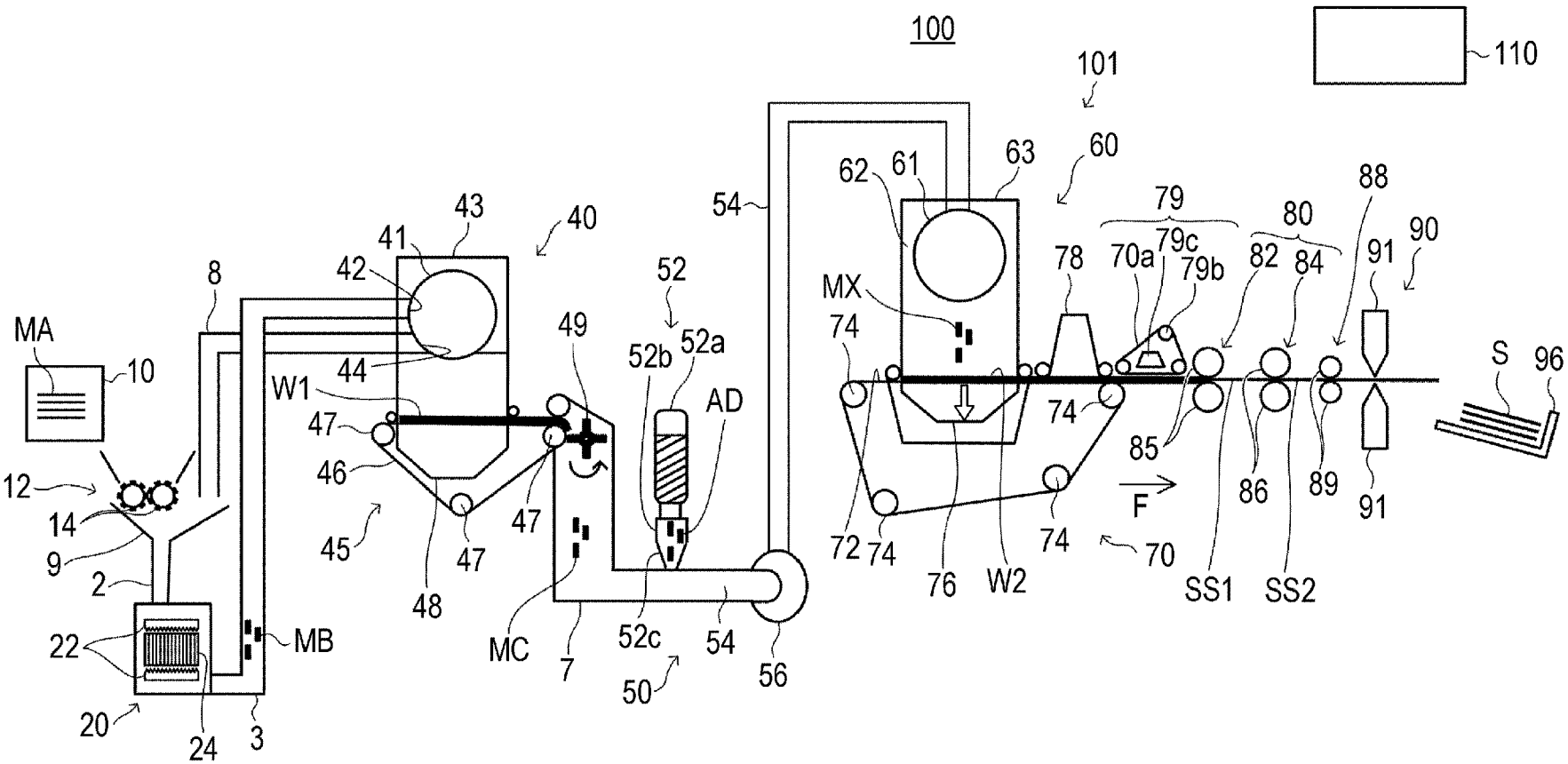
FIG. 1 is a schematic diagram illustrating a configuration of a sheet manufacturing apparatus of a first embodiment.

FIG. 1 is a schematic configuration view illustrating the configuration of a sheet manufacturing apparatus 100.

The sheet manufacturing apparatus 100 fiberizes a feedstock MA containing fibers to execute a recycling process which recycles the feedstock MA into a new sheet S. The sheet manufacturing apparatus 100 is capable of producing a plurality of kinds of the sheet S and, for example, is capable of adjusting the bonding strength and the whiteness of the sheet S, and of adding functions such as color, scent and flameproofing according to purpose by mixing additives into the feedstock MA. The sheet manufacturing apparatus 100 is capable of adjusting the density, thickness, size, and shape of the sheet S. Representative examples of the sheet S include paper plate-like and the like in addition to sheet-like products such as printing paper of standard sizes such as A4 and A3, cleaning sheets such as floor cleaning sheets, sheets for oil dirtying, and toilet cleaning sheets. The sheet manufacturing apparatus 100 corresponds to a fibrous feedstock recycling apparatus and a transporting apparatus of the present disclosure.

The sheet manufacturing apparatus 100 is provided with a supply section 10, a crushing section 12, a defibrating section 20, a sorting section 40, a first web forming section 45, a rotating body 49, a mixing section 50, a dispersing section 60, a second web forming section 70, a web moving section 79, a molding section 80, a pre-cutting transport section 88, and a cutting section 90. These sections execute a manufacturing step of manufacturing the sheet S from the feedstock MA in the order the sections are listed. The sheet manufacturing apparatus 100 forms a pressurized sheet SS1 and a heated sheet SS2 as intermediate products in the process of manufacturing the sheet S.

In the manufacturing step of the sheet S, the sections from the supply section 10 to the web moving section 79 configure a forming section 101. The forming section 101 forms a second web W2 from the feedstock MA. The forming section 101 may include a pressurizing section 82 which forms the pressurized sheet SS1 from the second web W2 and a heating section 84 which forms the heated sheet SS2 from the pressurized sheet SS1. The cutting section 90 corresponds to a processing section that subjects the heated sheet SS2 to a cutting process.

The supply section 10 is an automatic feeding device which stores the feedstock MA and continually feeds the feedstock MA into the crushing section 12. The feedstock MA may be any feedstock containing fibers, for example, old paper, waste paper, or pulp sheets.

The crushing section 12 is provided with a crushing blade 14 which cuts the feedstock MA supplied by the supply section 10, the crushing section 12 using the crushing blade 14 to cut the feedstock MA in the air to obtain rectangular shreds several cm in size. The shape and size of the shreds are arbitrary. It is possible to use a shredder, for example, for the crushing section 12. The feedstock MA cut by the crushing section 12 is gathered in a hopper 9 and is transported to the defibrating section 20 via a tube 2.

The defibrating section 20 defibrates the crushed pieces that are cut by the crushing section 12. Defibration is processing in which the feedstock MA in a state in which a plurality of fibers is bound together is untangled into single or low numbers of fibers. It is possible to refer to the feedstock MA as defibration target object. It is possible to anticipate an effect of causing matter such as resin granules, ink, toner, and bleeding inhibitor adhered to the feedstock MA to separate from the fibers due to the defibrating section 20 defibrating the feedstock MA. The object which passes the defibrating section 20 is referred to as a defibrated material. In addition to the defibrated material which is untangled, the defibrated material may include resin granules which separate from the fibers when untangling the fibers, colorants such as ink and toner, and additives such as a bleeding inhibitor and paper strengthener. The resin granules contained in the defibrated material are a resin mixture in which the fibers in a plurality of fibers are caused to bond to each other during the manufacturing of the feedstock MA. The shape of the fibers contained in the defibrated material is a string shape, flat string shape, or the like. The fibers contained in the defibrated material may be present in an independent state of not being tangled with other fibers. Alternatively, the fibers may be tangled with other untangled defibrated material to form a lump shape and be present in a state of forming so-called clumps.

The defibrating section 20 is a device that defibrates the crushed pieces cut by the crushing section 12 using a dry system. It is possible to configure the defibrating section 20 using a defibrator such as an impeller mill, for example. The defibrating section 20 of the present embodiment is a mill provided with a cylindrical stator 22 and a rotor 24 which rotates in the inner portion of the stator 22, defibrating blades being formed on the inner circumferential surface of the stator 22 the outer circumferential surface of the rotor 24. The crushed pieces are pinched between the stator 22 and the rotor 24 to be defibrated by the rotation of the rotor 24. A defibrated material MB defibrated by the defibrating section 20 is fed from the discharge port of the defibrating section 20 to the tube 3. The dry system indicates that the processes such as the defibrating are performed not in a liquid but in a gas such as in the air.

The crushed pieces are transported from the crushing section 12 to the defibrating section 20 by an air current. The defibrated material MB is sent from the defibrating section 20 to the sorting section 40 via the tube 3 by an air current. These air currents may be generated by the defibrating section 20, and a blower (not illustrated) may be provided to generate the air currents.

The sorting section 40 sorts the components contained in the defibrated material MB according to the size of the fibers. The size of the fibers mainly indicates the length of the fibers.

The sorting section 40 of the present embodiment includes a drum section 41 and a housing section 43 which stores the drum section 41. The drum section 41 is a so-called sieve such as a mesh having openings, a filter, or a screen, for example. Specifically, the drum section 41 has a cylindrical shape rotationally driven by a motor, and at least a portion of the circumferential surface is a mesh. The drum section 41 may be configured by a metal mesh, expanded metal in which a metal plate having cuts therein is stretched out, perforated metal, or the like. The drum section 41 is driven to rotate by a first drum drive section 325 (described later).

The defibrated material MB which is introduced into the inner portion of the drum section 41 from an inlet 42, through the rotation of the drum section 41, is divided into passed object which passes through the openings in the drum section 41 and residue which does not pass through the openings. The passed object which passes through the openings contains fibers, particles, and the like smaller than the openings and is a first sorted object. The residue contains fibers, non-defibrated pieces, lumps, and the like larger than the openings and is referred to as a second sorted object. The first sorted object descents the inner portion in the housing section 43 toward the first web forming section 45. The second sorted object is transported to the defibrating section 20 via a tube 8 from a discharge port 44 communicating with the inner portion of the drum section 41.

Instead of the sorting section 40, the sheet manufacturing apparatus 100 may be provided with a classifier which separates the first sorted object and the second sorted object. The classifier is a cyclone classifier, an elbow jet classifier, or an eddy classifier, for example.

The first web forming section 45 includes a mesh belt 46 positioned under the drum section 41 and forms a first web W1 by molding the first sorted object separated by the sorting section 40 into a web-like form.

The first web forming section 45 includes the mesh belt 46, stretch rollers 47, and an aspiration section 48. The mesh belt 46 is an endless metal belt and bridges across the plurality of stretch rollers 47. One or more of the stretch rollers 47 is driven to rotate by a first belt drive section 326 (described later) and causes the mesh belt 46 to move. The mesh belt 46 goes around a track configured by the stretch rollers 47. A portion of the track of the mesh belt 46 is planar on the bottom of the drum section 41 and configures a planar surface of the mesh belt 46.

Multiple openings are formed in the mesh belt 46 and, of the first sorted object which descends from the drum section 41, a component that is larger than the openings in the mesh belt 46 accumulates on the mesh belt 46. The component of the first sorted object that is smaller than the openings in the mesh belt 46 passes through the openings. The component which passes through the openings in the mesh belt 46 is referred to as a third sorted object, and, for example, contains fibers shorter than the openings in the mesh belt 46, resin granules separated from the fibers by the defibrating section 20, and particles including ink, toner, bleeding inhibitor, and the like.

The aspiration section 48 is connected to a blower (not illustrated) and aspirates the air from the bottom of the mesh belt 46 using an aspiration force of the blower. The air which is aspirated from the aspiration section 48 is discharged together with the third sorted object which passes through the openings in the mesh belt 46.

Since the air current which is aspirated by the aspiration section 48 pulls the first sorted object which descends from the drum section 41 toward the mesh belt 46, there is an effect of promoting accumulation.

The component which accumulates on the mesh belt 46 becomes web-like and configures the first web W1. In other words, the first web forming section 45 forms the first web W1 from the first sorted object sorted by the sorting section 40.

The main component of the first web W1 is fibers larger than the openings in the mesh belt 46, of the components contained in the first sorted object, and the first web W1 is formed in a soft state containing much air. The first web W1 is transported by the rotating body 49 together in accordance with the movement of the mesh belt 46.

The rotating body 49 is provided with a plurality of plate-like blades and is driven to rotate by a rotating body drive section 327 (described later). The rotating body 49 is disposed at an end portion of the track of the mesh belt 46 and comes into contact with a location on the rotating body 49 at which the first web W1 transported by the mesh belt 46 protrudes from the mesh belt 46. The first web W1 is untangled by the rotating body 49 colliding with the first web W1, becomes small fiber lumps, passes through the tube 7, and is transported to the mixing section 50. The material obtained by cutting the first web W1 with the rotating body 49 is a material MC. The material MC is obtained by removing the third sorted object from the first sorted object and the main component of the material MC is fibers.

In this manner, the sorting section 40 and the first web forming section 45 have a function of separating the material MC mainly containing fibers from the defibrated material MB.

An additive supply section 52 is a device which adds an additive material AD to a tube 54 carrying the material MC. An additive cartridge 52*a* which accumulates the additive material AD is set in the additive supply section 52. The additive cartridge 52*a* is a tank storing the additive material AD and may be attachable and detachable with respect to the additive supply section 52. The additive supply section 52 is provided with an additive dispensing section 52*b* which dispenses the additive material AD from the additive cartridge 52*a* and an additive feeding section 52*c* which discharges the additive material AD dispensed by the additive dispensing section 52*b* to the tube 54. The additive dispensing section 52*b* is provided with a feeder which sends the additive material AD to the additive feeding section 52*c*. The additive feeding section 52*c* is provided with a shutter capable of opening and closing and sends the additive material AD to the tube 54 by opening the shutter.

The additive material AD may contain a bonding agent for bonding a plurality of fibers together. The bonding agent is a synthetic resin or a natural resin, for example. The resin contained in the additive material AD is melted to bond the plurality of fibers together when passing through the molding section 80. The resin is a thermoplastic resin or a heat curing resin, for example, the resin is AS resin, ABS resin, polypropylene, polyethylene, polyvinyl chloride, polystyrene, acrylic resin, polyester resin, polyethylene terephthalate, polyphenylene ether, polybutylene terephthalate, nylon, polyamide, polycarbonate, polyacetal, polyphenylene sulfide, polyether ether ketone, or the like. These resins may be used on their own or in a mixture, as appropriate.

The additive material AD may contain components other than the resin which bonds the fibers together. For example, depending on the kind of the sheet S to be manufactured, the additive material AD may contain a colorant for coloring the fibers, an aggregation inhibitor for preventing aggregation of the fibers and aggregation of the resin, a flame retardant for rendering the fibers and the like less susceptible to burning, and the like. The additive material AD may be fiber form and may be powder form.

The mixing section 50 mixes the material MC and the additive material AD together using a mixing blower 56. The mixing section 50 may contain the tube 54 which transports the material MC and the additive material AD to the mixing blower 56.

The mixing blower 56 generates an air current in the tube 54 joining the tube 7 to the dispersing section 60 and mixes the material MC and the additive material AD together. The mixing blower 56 is provided with, for example, a motor, blades driven to rotate by the motor, and a case storing the blades. The mixing blower 56 may be provided with, in addition to the blades generating the air current, a mixer which mixes the material MC and the additive material AD together. Hereinafter, the mixture mixed in the mixing section 50 will be referred to as a mixture MX. The mixture MX is transported to the dispersing section 60 by the air current generated by the mixing blower 56 and is introduced to the dispersing section 60.

The dispersing section 60 untangles the fibers of the mixture MX and causes the untangled fibers to descend onto the second web forming section 70 while dispersing the fibers in the atmosphere. In a case in which the additive material AD is fiber-like, these fibers are also untangled by the dispersing section 60 and descend onto the second web forming section 70.

The dispersing section 60 includes a drum section 61 and a housing 63 storing the drum section 61. The drum section 61 is a cylindrical structural body configured in the same manner as the drum section 41, for example. The drum section 61 is driven to rotate by a second drum drive section 328 (described later) and functions as a sieve. The drum section 61 has an opening and causes the mixture MX untangled by the rotation of the drum section 61 to descend from the opening. Accordingly, the mixture MX descends from the drum section 61 in an inner portion space 62 formed in the inner portion of the housing 63.

The second web forming section 70 is disposed below the drum section 61. The second web forming section 70 includes a mesh belt 72, stretch rollers 74, and a suction mechanism 76.

The mesh belt 72 is configured by an endless metal belt similar to the mesh belt 46 and bridges across a plurality of stretch rollers 74. One or more of the stretch rollers 74 is driven to rotate by a second belt drive section 329 (described later) and causes the mesh belt 72 to move. The mesh belt 72 moves in a transport direction indicated by symbol F 1 while going around a track configured by the stretch rollers 74. A portion of the track of the mesh belt 72 is planar on the bottom of the drum section 61 and configures a planar surface of the mesh belt 72.

Multiple openings are formed in the mesh belt 72 and, of the mixture MX which descends from the drum section 61, a component that is larger than the openings in the mesh belt 72 accumulates on the mesh belt 72. The component of the mixture MX that is smaller than the openings in the mesh belt 72 passes through the openings.

The suction mechanism 76 uses the aspiration force of a blower (not illustrated) to aspirate the air from the opposite side of the mesh belt 72 from the drum section 61. The component that passes through the openings in the mesh belt 72 is sucked up by the suction mechanism 76. The air current aspirated by the suction mechanism 76 pulls the mixture MX descending from the drum section 61 toward the mesh belt 72 to promote the accumulation of the mixture MX. The air current of the suction mechanism 76 forms a downflow in the path in which the mixture MX descends from the drum section 61 and it is possible to anticipate an effect of preventing the tangling of the fibers while the fibers fall.

In the transport path of the mesh belt 72, a moisture adjusting section 78 is provided downstream of the dispersing section 60. The moisture adjusting section 78 is a mist system humidifier which turns water into mist form and supplies the mist toward the mesh belt 72 and is provided with, for example, a tank storing water and an ultrasonic transducer which turns the water into mist form. The water content of the second web W2 is adjusted due to the moisture adjusting section 78 supplying the mist and attraction of fibers to the mesh belt 72 caused by static electricity and the like are suppressed. The moisture adjusting section 78 may be configured to be connected to a vaporizing humidifier which adjusts the moisture in the air and to supply the air which is humidified by the vaporizing humidifier to the mesh belt 72.

The second web W2 is peeled from the mesh belt 72 and transported to the molding section 80 by the web moving section 79. The web moving section 79 includes a mesh belt 79*a*, a roller 79*b*, and a suction mechanism 79*c*. The suction mechanism 79*c* is provided with a blower (not illustrated) and generates an upward air current through the mesh belt 79*a* using the aspiration force of the blower. It is possible to configure the mesh belt 79*a* using an endless metal belt having openings similar to the mesh belt 46 and the mesh belt 72. The mesh belt 79*a* is moved by the rotation of the roller 79*b* and moves on a turning track. In the web moving section 79, the second web W2 separates from the mesh belt 72 and is attracted to the mesh belt 79*a* due to the aspiration force of the suction mechanism 79*c*. The second web W2 moves with the mesh belt 79*a* and is transported to the molding section 80.

The molding section 80 is provided with the pressurizing section 82 and the heating section 84. The pressurizing section 82 is provided with a pair of pressurizing rollers 85, 85 and pressurizes the second web W2 at a predetermined nipping pressure to adjust the thickness of the second web W2 and increase the density of the second web W2. The pressurized sheet SS1 is formed from the second web W2 due to the processing of the pressurizing section 82.

The heating section 84 is provided with a pair of heating rollers 86 and binds the fibers originating from the material MC using the resin contained in the additive material AD by applying heat to the pressurized sheet SS1. Accordingly, the heated sheet SS2 is formed from the pressurized sheet SS1. The heated sheet SS2 is a sheet-like intermediate product subjected to pressurization and heating by the molding section 80 in which the strength, elasticity, and density of the second web W2 are increased. The heated sheet SS2 is transported to the cutting section 90 by the pre-cutting transport section 88.

The cutting section 90 is provided with a cutter 91. The cutter 91 is driven by a cutter drive section 330 (described later) to perform a process of pinching and cutting the heated sheet SS2 and to manufacture the sheet S of a set size. The cutter 91 cuts the heated sheet SS2 in a direction intersecting a transport direction F, for example. The cutting section 90 may be provided with a second cutter which cuts the heated sheet SS2 in a direction parallel to the transport direction F.

The sheet S cut by the cutting section 90 is discharged to a discharge portion 96. The discharge portion 96 is provided with a tray or a stacker which stores the sheet S. The user is capable of taking out and using the sheet S stored in the discharge portion 96.

The sheet manufacturing apparatus 100 is not limited to the configuration in which the first web W1 is transported in processes of the rotating body 49 onward. For example, the first web W1 may be taken out from the sheet manufacturing apparatus 100 and stored. A mode may be adopted in which the first web W1 is sealed in a predetermined package and transporting and transaction are possible. In this case, in the sheet manufacturing apparatus 100, a configuration may be adopted in which the first web W1 which is stored is supplied to the rotating body 49 or the mixing section 50 and it is possible to manufacture the sheet S.

The operations of the sheet manufacturing apparatus 100 are controlled by a control device 110. The configuration and the function of the control device 110 will be described later.

1-2. Configuration of Pressurizing Section and Heating Section

Figure 2:
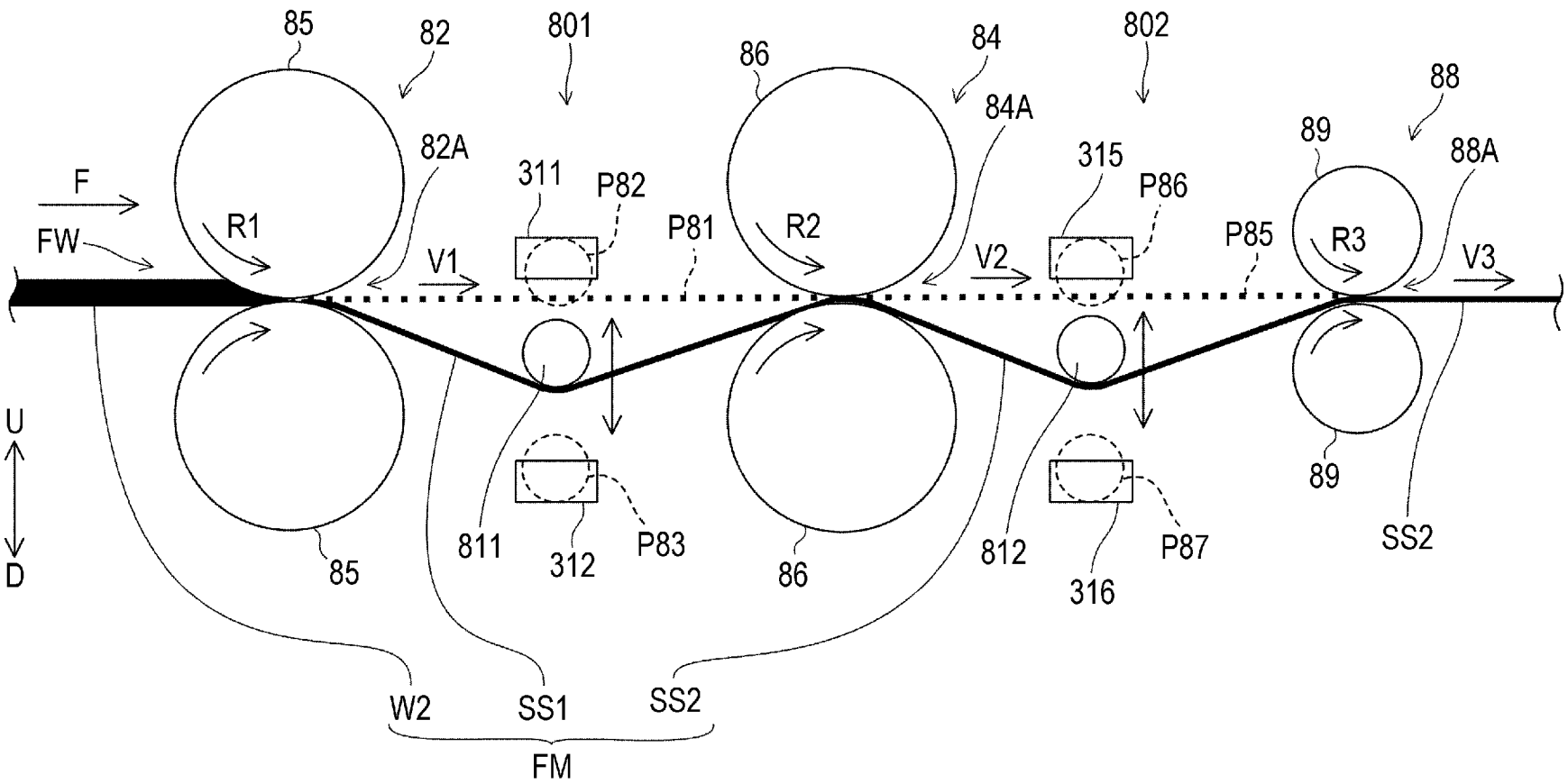
FIG. 2 is a view illustrating a configuration of a pressurizing section, a heating section, and a pre-cutting transport section configuring a transport section.

FIG. 2 is a view illustrating a configuration of the pressurizing section 82, the heating section 84, and the pre-cutting transport section 88 configuring a transport section. The transport section transports the second web W2, the pressurized sheet SS1, and the heated sheet SS2. The second web W2, the pressurized sheet SS1, and the heated sheet SS2 will be collectively referred to as a transport target object FM. The transport target object FM corresponds to a processing target object. The path along which the transport target object FM is transported is a transport path FW.

In FIG. 2, the transport direction of the material in the process of the sheet S being manufactured from the second web W2 is indicated by the symbol F, and in the present embodiment, the transport direction F is horizontal, for example. FIG. 2 indicates the up and down directions with respect to the transport direction F using arrows U and D. The arrow U faces upward and the arrow D faces downward.

The pressurizing section 82 includes the pair of pressurizing rollers 85 facing each other to interpose the transport path FW. The two pressurizing rollers 85 are pressurized in directions approaching each other by the motive force of a hydraulic drive section 331 (described later). According to the pressure, the second web W2 is pressurized by a nipping portion 82A of the pressurizing rollers 85 to increase in density and form the pressurized sheet SS1.

One of the pair of pressurizing rollers 85 is a drive roller driven by a pressurizing roller drive section 341 (described later) and the rotation speed of the pressurizing rollers 85 is controlled by the control device 110. Alternatively, both of the pair of pressurizing rollers 85 may be drive rollers. The pair of pressurizing rollers 85 rotate in a direction indicated by arrows in each of the drawings and transports the pressurized sheet SS1 toward the heating section 84.

In the following explanation, the rotation speeds of the pressurizing rollers 85 will be referred to as a rotation speed R1. The rotation speeds of the pressurizing roller 85 of the U side of the transport path FW and the pressurizing roller 85 of the D side are substantially the same. The speed at which the second web W2 and the pressurized sheet SS1 are transported by the rotation of the pressurizing rollers 85 is a transport speed V1.

The heating section 84 includes the pair of heating rollers 86 facing each other to interpose the transport path FW. The two heating rollers 86 are both heated to a temperature set by a roller heating section 332 (described later). The roller heating section 332 is provided with a heater which heats the heating rollers 86, for example. Examples of specific modes of the heater configuring the roller heating section 332 include heaters in contact with the outer circumferential surface of the heating rollers 86 and heaters disposed in the inner portions of the heating rollers 86. For these heaters, it is possible to use a resistor heater containing a ceramic heater, a heat ray radiating heater, a heater which heats the heating rollers 86 using microwaves, or the like. The heating rollers 86 may be configured such that heat-generating bodies are embedded therein.

The heating section 84 interposes the pressurized sheet SS1 using the pair of heating rollers 86 and heats the pressurized sheet SS1. Since the pressurized sheet SS1 is heated by the heating rollers 86 to a temperature higher than the glass transition point temperature of the bonding agent contained in the additive material AD, the fibers contained in the mixture MX are bonded together by the bonding agent to form the heated sheet SS2. In the heated sheet SS2, since the fibers are bonded by the bonding agent, the overall elasticity and hardness of the heated sheet SS2 are high as compared to the second web W2 and the pressurized sheet SS1. The heated sheet SS2 has a degree of strength at which it is possible to maintain a sheet shape.

One of the heating rollers 86 is a drive roller driven by a heating roller drive section 342 (described later). Alternatively, both of the heating rollers 86 may be drive rollers. The rotation speed of the heating rollers 86 is controlled by the control device 110. Each roller in the pair of heating rollers 86 rotates in a direction indicated by an arrow in the drawings and transports the heated sheet SS2 toward the cutting section 90. In the following explanation, the rotation speed of the heating rollers 86 will be referred to as a rotation speed R2. The rotation speeds of the heating roller 86 of the U side of the transport path FW and the heating roller 86 of the D side are substantially the same. The speed at which the pressurized sheet SS1 and the heated sheet SS2 are transported by the rotation of the heating rollers 86 is a transport speed V2.

The pre-cutting transport section 88 is disposed between the heating section 84 and the cutting section 90, that is, downstream of the heating section 84 in the transport direction F. The pre-cutting transport section 88 is provided with a pair of transport rollers 89 and interposes the heated sheet SS2 with the transport rollers 89 to transport the heated sheet SS2 toward the cutting section 90. The transport rollers 89 are drive rollers driven by a transport roller drive section 343 (described later). The rotation speed of the transport rollers 89 is controlled by the control device 110. In the pre-cutting transport section 88, a configuration may be adopted in which one of the transport rollers 89 is a drive roller and one of the transport rollers 89 is a follower roller, and a configuration may be adopted in which the two transport rollers 89 are drive rollers.

The pair of transport rollers 89 are disposed facing each other to interpose the transport path FW. The rotation speed of the transport rollers 89 is controlled by the control device 110. Each roller in the pair of transport rollers 89 rotates in a direction indicated by an arrow in the drawings and transports the heated sheet SS2 toward the cutting section 90. In the following explanation, the rotation speed of the transport rollers 89 will be referred to as a rotation speed R3. The rotation speeds of the transport roller 89 of the U side of the transport path FW and the transport roller 89 of the D side are considered to be substantially the same. The speed at which the heated sheet SS2 is transported by the rotation of the transport rollers 89 is a transport speed V3.

1-3. Configuration of Buffer Portions

In the transport path FW, the space between the pressurizing section 82 and the heating section 84 is a first buffer portion 801. In further detail, the first buffer portion 801 is the space between the nipping portion 82A and the nipping portion 84A. A first tension roller 811 in contact with the pressurized sheet SS1 from the U side is disposed in the first buffer portion 801. An external force toward the D direction is applied to the first tension roller 811 and the first tension roller 811 pushes the pressurized sheet SS1 in the D direction according to the external force.

In the first buffer portion 801, when the transport speed V2 is a lower speed than the transport speed V1, the length of the pressurized sheet SS1 in the first buffer portion 801 is longer than a minimum distance between the nipping portion 82A and the nipping portion 84A and slack is generated in the pressurized sheet SS1. In other words, there is an excess of the pressurized sheet SS1 by the amount by which the pressurized sheet SS1 is longer than the minimum distance between the nipping portion 82A and the nipping portion 84A. The first tension roller 811 pushes the pressurized sheet SS1 to the D side. Since the pressurized sheet SS1 is pushed by the first tension roller 811 and moves to the D side by the amount of excess length, a tension is applied to the pressurized sheet SS1 and the slack is suppressed.

The first tension roller 811 moves in the U-D directions according to the excess amount of the pressurized sheet SS1. In detail, when the excess amount is great, the first tension roller 811 moves in the D direction, and when the excess amount is little, the first tension roller 811 moves in the U direction.

In the transport path FW, the space between the heating section 84 and the pre-cutting transport section 88 is a second buffer portion 802. In further detail, the second buffer portion 802 is the space between the nipping portion 84A and a nipping portion 88A. A second tension roller 812 in contact with the heated sheet SS2 from the U side is disposed in the second buffer portion 802. An external force toward the D direction is applied to the second tension roller 812 and the second tension roller 812 pushes the heated sheet SS2 in the D direction according to the external force.

In the second buffer portion 802, when the transport speed V2 is a lower speed than the transport speed V3, the length of the heated sheet SS2 in the second buffer portion 802 is longer than a minimum distance between the nipping portion 84A and the nipping portion 88A and slack is generated in the heated sheet SS2. In other words, there is an excess of the heated sheet SS2 by the amount by which the heated sheet SS2 is longer than the minimum distance between the nipping portion 84A and the nipping portion 88A. The second tension roller 812 pushes the heated sheet SS2 to the D side. Since the heated sheet SS2 is pushed by the second tension roller 812 and moves to the D side by the amount of excess length, a tension is applied to the heated sheet SS2 and the slack is suppressed.

The second tension roller 812 moves in the U-D directions according to the excess amount of the heated sheet SS2. In detail, when the excess amount is great, the second tension roller 812 moves in the D direction, and when the excess amount is little, the second tension roller 812 moves in the U direction.

The first buffer portion 801 and the second buffer portion 802 have a function of stabilizing the transporting of the transport target object FM. When the transport speed V2 is a higher speed than the transport speed V1, there is a possibility that excessive tension is applied to the pressurized sheet SS1. Therefore, the control device 110 controls the rotation of the pressurizing rollers 85 and the heating rollers 86 such that the transport speed V2 is less than or equal to the transport speed V1. As a result of this control, when there is an excess of the pressurized sheet SS1 in the first buffer portion 801 due to a speed difference between the transport speed V2 and the transport speed V1, the first tension roller 811 moves according to the excess amount of the pressurized sheet SS1 and the slack in the pressurized sheet SS1 is suppressed.

Similarly, the control device 110 performs control such that the transport speed V3 is a speed less than or equal to the transport speed V2. As a result of this control, when there is an excess of the heated sheet SS2 in the second buffer portion 802 due to a speed difference between the transport speed V3 and the transport speed V2, the second tension roller 812 moves according to the excess amount of the heated sheet SS2 and the slack in the heated sheet SS2 is suppressed.

Accordingly, it is possible to transport the transport target object FM such that slack in the transport target object FM and excessive tension in the transport target object FM are not generated in the first buffer portion 801 and the second buffer portion 802.

FIG. 2 depicts a position P81 of the pressurized sheet SS1 when the excess amount of the pressurized sheet SS1 is at a minimum in the first buffer portion 801 using a dashed line. The position P81 is the transport path FW when the pressurized sheet SS1 is shortest in the first buffer portion 801.

A position P82 of the first tension roller 811 when the excess amount of the pressurized sheet SS1 is small is depicted using a dashed line and a position P83 of the first tension roller 811 when the excess amount of the pressurized sheet SS1 is great is depicted using a dashed line. Although the position P82 may be the position of the first tension roller 811 when the pressurized sheet SS1 is shortest, it is preferable that the position P82 be a position shifted to be closer to the D side than the position of the first tension roller 811 when the pressurized sheet SS1 is shortest.

A first top sensor 311 and a first bottom sensor 312 which detect the pressurized sheet SS1 are disposed in the first buffer portion 801.

Although the first top sensor 311 and the first bottom sensor 312 may be sensors which directly detect the pressurized sheet SS1, in the present embodiment, the first top sensor 311 and the first bottom sensor 312 indirectly detect the pressurized sheet SS1 by detecting the first tension roller 811.

The first top sensor 311 may be a transmitting or a reflecting light sensor, for example. For example, when the first tension roller 811 is a permanent magnetic body or a strong magnetic body such as a metal, the first top sensor 311 may be a magnetic sensor. The same applies to the first bottom sensor 312.

The first top sensor 311 is disposed on the U side and the first bottom sensor 312 is disposed on the D side in a movement range of the first tension roller 811. The first top sensor 311 detects the first tension roller 811 at the position P82 and the first bottom sensor 312 detects the first tension roller 811 at the position P83. In other words, the first top sensor 311 and the first bottom sensor 312 are disposed in the transport path FW in the U-D directions intersecting the transport path FW. The first top sensor 311 and the first bottom sensor 312 are disposed to face each other in the U-D directions.

Using the first top sensor 311 and the first bottom sensor 312, it is possible to detect that the first tension roller 811 reaches the position P82 or the position P83 when the first tension roller 811 is displaced in the U-D directions corresponding to the excess amount of the pressurized sheet SS1.

FIG. 2 depicts a position P85 of the heated sheet SS2 when an excess amount of the heated sheet SS2 is smallest in the second buffer portion 802 using a dashed line. The position P85 is the transport path FW when the heated sheet SS2 is shortest in the second buffer portion 802. A position P86 of the second tension roller 812 when the excess amount of the heated sheet SS2 is smallest is depicted using a dashed line and a position P87 of the second tension roller 812 when the excess amount of the heated sheet SS2 is great is depicted using a dashed line. Although the position P86 may be the position of the second tension roller 812 when the heated sheet SS2 is shortest, it is preferable that the position P86 be a position shifted to be closer to the D side than the position of the second tension roller 812 when the heated sheet SS2 is shortest.

A second top sensor 315 and a second bottom sensor 316 which detect the heated sheet SS2 are disposed in the second buffer portion 802.

Although the second top sensor 315 and the second bottom sensor 316 may be sensors which directly detect the heated sheet SS2, in the present embodiment, the second top sensor 315 and the second bottom sensor 316 indirectly detect the heated sheet SS2 by detecting the second tension roller 812.

The second top sensor 315 may be a transmitting or a reflecting light sensor, for example. For example, when the second tension roller 812 is a permanent magnetic body or a strong magnetic body such as a metal, the second top sensor 315 may be a magnetic sensor. The same applies to the second bottom sensor 316.

The second top sensor 315 is disposed on the U side and the second bottom sensor 316 is disposed on the D side in a movement range of the second tension roller 812. The second top sensor 315 detects the second tension roller 812 at the position P86 and the second bottom sensor 316 detects the second tension roller 812 at the position P87. In other words, the second top sensor 315 and the second bottom sensor 316 are disposed in the transport path FW in the U-D directions intersecting the transport path FW. The second top sensor 315 and the second bottom sensor 316 are disposed to face each other in the U-D directions.

Using the second top sensor 315 and the second bottom sensor 316, it is possible to detect that the second tension roller 812 reaches the position P86 or the position P87 when the second tension roller 812 is displaced in the U-D directions corresponding to the excess amount of the heated sheet SS2.

As described later, the control device 110 acquires detection values of the first top sensor 311 and the first bottom sensor 312 and determines the position of the pressurized sheet SS1 in the first buffer portion 801. The control device 110 controls the rotation speed R2 of the heating rollers 86 based on the determination results. Similarly, the control device 110 acquires detection values of the second top sensor 315 and the second bottom sensor 316 and determines the position of the heated sheet SS2 in the second buffer portion 802. The control device 110 controls the rotation speed R3 of the pre-cutting transport section 88 based on the determination results. Accordingly, the sheet manufacturing apparatus 100 is capable of transporting the transport target object FM in the first buffer portion 801 and the second buffer portion 802 in a stable state.

1-4. Configuration of Control System of Sheet Manufacturing Apparatus

Figure 3:
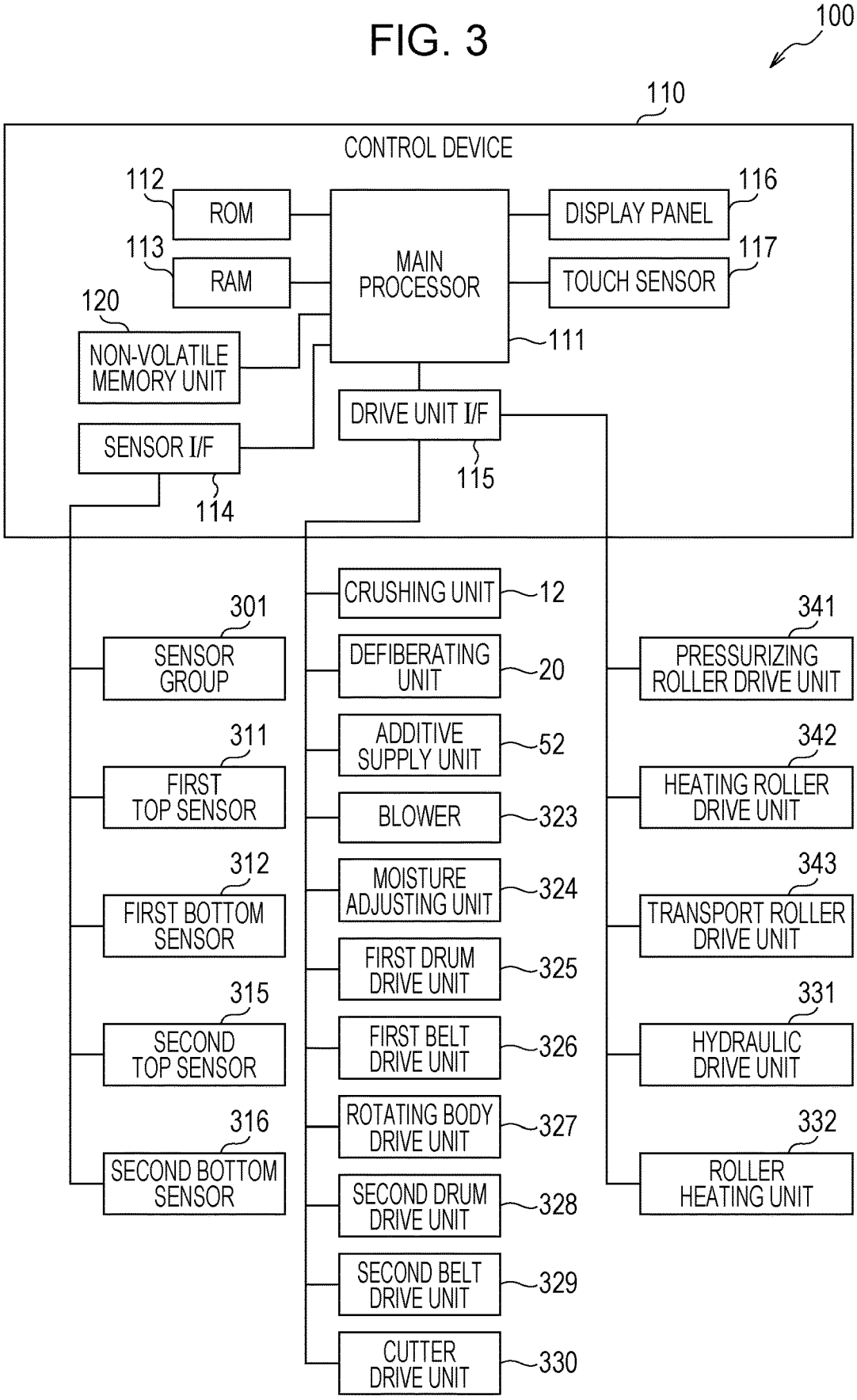
FIG. 3 is an explanatory diagram of a control system of the sheet manufacturing apparatus.

FIG. 3 is a block diagram illustrating the configuration of the control system of the sheet manufacturing apparatus 100.

The sheet manufacturing apparatus 100 is provided with the control device 110 including a main processor 111 controlling the parts of the sheet manufacturing apparatus 100.

The control device 110 is provided with the main processor 111, a read only memory (ROM) 112, and a random access memory (RAM) 113. The main processor 111 is an operation processing device such as a central processing section (CPU) and controls the parts of the sheet manufacturing apparatus 100 by executing a basic control program stored by the ROM 112. The main processor 111 may be configured as a system chip including peripheral circuits such as the ROM 112 and the RAM 113 and other IP cores.

The ROM 112 stores, in a non-volatile manner, a program to be executed by the main processor 111. The RAM 113 forms a working area used by the main processor 111 and temporarily stores a program to be executed by the main processor 111, processing target data, or the like.

The control device 110 is provided with a non-volatile memory section 120. The non-volatile memory section 120 stores a program to be executed by the main processor 111 and data to be processed by the main processor 111.

The control device 110 is provided with a sensor interface 114, a drive section interface 115, a display panel 116, and a touch sensor 117. In the following descriptions and drawings, the interface will be abbreviated to I/F.

The display panel 116 is a panel for displaying such as a liquid crystal display and is installed in the exterior packaging of the sheet manufacturing apparatus 100, for example. The display panel 116 displays the operational state, various setting values, warning displays, and the like of the sheet manufacturing apparatus 100 according to the control of the main processor 111.

The touch sensor 117 detects a touch manipulation or a push manipulation by a user. The touch sensor 117 is disposed to overlap the display surface of the display panel 116, for example, and detects manipulation of the display panel 116. The touch sensor 117 outputs, to the main processor 111, manipulation data containing a manipulation position, a number of manipulation positions, and the like corresponding to manipulation. The main processor 111 detects manipulation of the display panel 116 according to the output of the touch sensor 117 and acquires the manipulation position. The main processor 111 realizes graphical user interface (GUI) manipulation based on the manipulation position detected by the touch sensor 117 and display data 122 being displayed on the display panel 116.

The control device 110 connects to various sensors provided in the sheet manufacturing apparatus 100 via the sensor I/F 114.

The sensor I/F 114 is an interface which acquires detection values output by the sensors and inputs the detection values to the main processor 111. The sensor I/F 114 may be provided with an analogue/digital (A/D) converter which converts analogue signals output by the sensors to digital data. The sensor I/F 114 may supply a drive current to the sensors. The sensor I/F 114 may be provided with a circuit which acquires the output values of each of the sensors according to a sampling frequency specified by the main processor 111 and outputs the output values to the main processor 111.

The sensors connected to the sensor I/F 114 are sensors detecting the operational states of parts such as the supply section 10, the crushing section 12 the defibrating section 20, the sorting section 40, the first web forming section 45, the mixing section 50, the dispersing section 60, the second web forming section 70, and the web moving section 79. For example, the sensors may be a sensor detecting the amount of the feedstock MA in the supply section 10, a sensor or the like detecting the remaining amount of the additive material AD in the additive supply section 52, and a sensor detecting the material to be used by the sheet manufacturing apparatus 100 in the manufacturing of the sheet S. The sensors may also be sensors detecting the temperature and humidity in the inner portion of the sheet manufacturing apparatus 100, for example.

The first top sensor 311, the first bottom sensor 312, the second top sensor 315, and the second bottom sensor 316 are connected to the sensor I/F 114.

The sensor I/F 114 acquires, as a sampling frequency set for each of the sensors, the detection values of each of the sensors connected to the sensor I/F 114 according to the control of the control device 110. The sensor I/F 114 outputs the data indicating the detection values of the sensors to the control device 110.

The control device 110 is connected to each of the drive sections provided in the sheet manufacturing apparatus 100 via a drive section I/F 115. The drive sections provided in the sheet manufacturing apparatus 100 are motors, pumps, heaters, and the like. Besides a configuration in which the drive section I/F 115 is directly connected to the motors, the drive section I/F 115 may be connected to drive circuits or drive integrated circuits (IC) which supply the drive currents to the motors according to the control of the control device 110.

The crushing section 12, the defibrating section 20, and the additive supply section 52 are connected to the drive section I/F 115 as control targets of the control device 110. The control target of the control device 110 in the crushing section 12 is a motor (not illustrated) or the like which operates the crushing blade 14. The control target of the control device 110 in the defibrating section 20 is a motor (not illustrated) or the like which causes the rotor 24 to rotate. The control targets in the additive supply section 52 are an actuator, motor, and the like (not illustrated) which drive the feeder of the additive dispensing section 52*b* and the shutter of the additive feeding section 52*c*.

A blower 323, a moisture adjusting section 324, the first drum drive section 325, the first belt drive section 326, the rotating body drive section 327, the second drum drive section 328, the second belt drive section 329, and the cutter drive section 330 are connected to the drive section I/F 115.

The blower 323 contains a blower connected to the aspiration section 48, the suction mechanisms 76 and 79*c*, and the mixing blower 56, and other blowers (not illustrated).

The moisture adjusting section 324 contains a drive section (not illustrated) such as an ultrasonic wave vibration generating device, a fan, or a pump provided in the moisture adjusting section 78.

The first drum drive section 325 is a motor or the like which causes the drum section 41 to rotate. The first belt drive section 326 is a motor or the like which operates the mesh belt 46. The rotating body drive section 327 is a motor or the like which causes the rotating body 49 to rotate. The second drum drive section 328 is a motor or the like which causes the drum section 61 to rotate. The second belt drive section 329 is a motor or the like which operates the mesh belt 72. The cutter drive section 330 is a motor, an actuator, or the like which drives the cutter 91.

The hydraulic drive section 331, the roller heating section 332, the pressurizing roller drive section 341, the heating roller drive section 342, and the transport roller drive section 343 are connected to the drive section I/F 115.

The hydraulic drive section 331 is a drive section having a hydraulic mechanism (not illustrated) provided in the pressurizing section 82 and applies pressure to the pressurizing rollers 85 to apply a predetermined nipping pressure to the nipping portion 82A.

The roller heating section 332 is a heater (not illustrated) provided in the heating section 84 and heats the heating rollers 86.

The pressurizing roller drive section 341 contains a motor which causes the pressurizing rollers 85 to rotate. The pressurizing roller drive section 341 operates according to the control of the control device 110 to cause the pressurizing rollers 85 to rotate. The control device 110 is capable of increasing and decreasing the speed of the rotation speed R1 of the pressurizing rollers 85 by controlling the pressurizing roller drive section 341.

The heating roller drive section 342 contains a motor which causes the heating rollers 86 to rotate. The heating roller drive section 342 operates according to the control of the control device 110 to cause the heating rollers 86 to rotate. The control device 110 is capable of increasing and decreasing the speed of the rotation speed R2 of the heating rollers 86 by controlling the heating roller drive section 342.

The transport roller drive section 343 contains a motor which causes the transport rollers 89 to rotate. The transport roller drive section 343 operates according to the control of the control device 110 to cause the transport rollers 89 to rotate. The control device 110 is capable of increasing and decreasing the speed of the rotation speed R3 of the transport rollers 89 by controlling the transport roller drive section 343.

1-5. Configuration of Control Device

Figure 4:
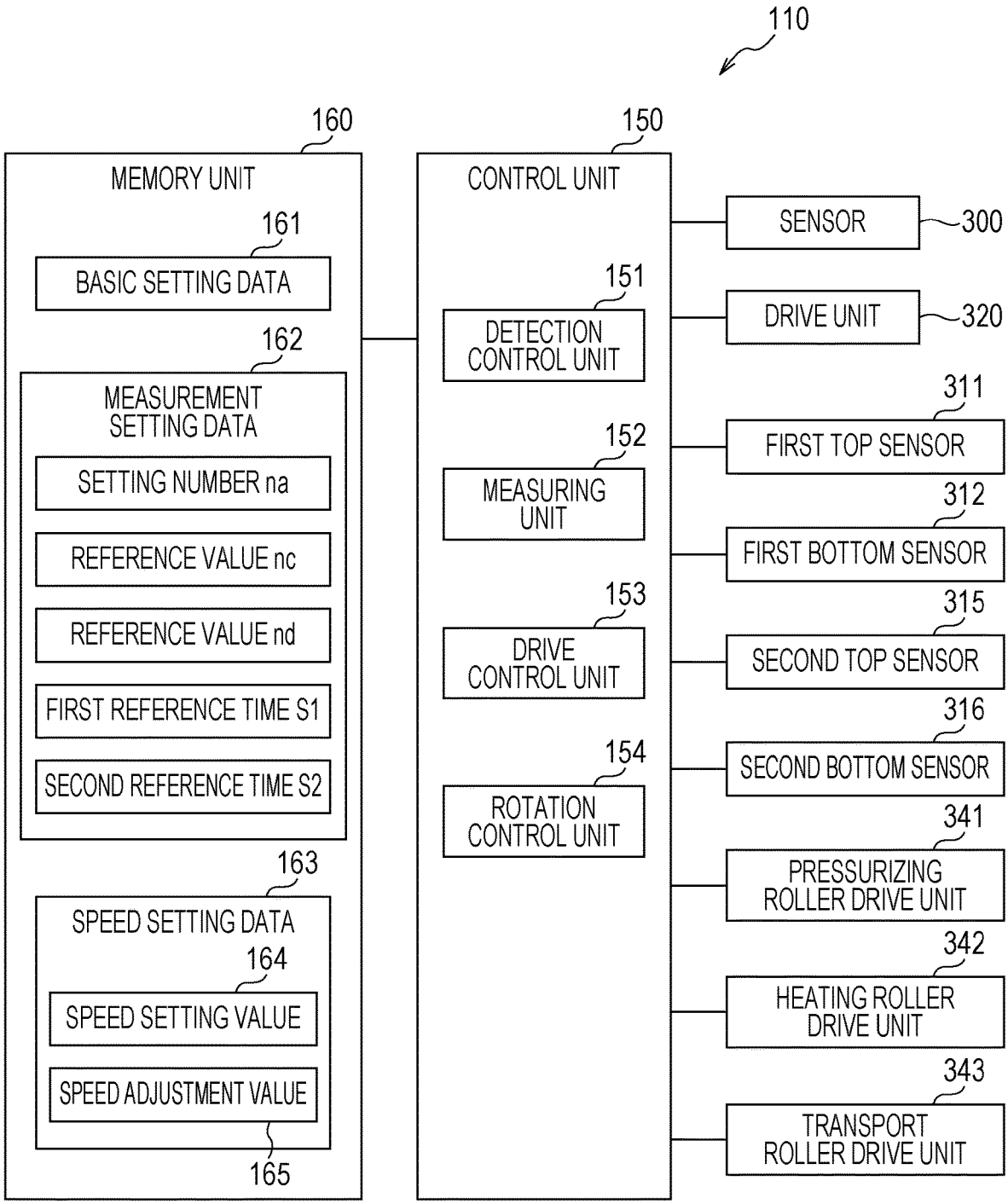
FIG. 4 is a functional block diagram of a control device.

FIG. 4 is a functional block diagram of the control device 110.

The control device 110 realizes various functional sections using cooperation between software and hardware by executing a program using the main processor 111. FIG. 4 illustrates the function of the main processor 111 including the functional sections as a control section 150. The control device 110 uses a memory region of the non-volatile memory section 120 to configure a memory section 160 which is a logical memory device. Here, the memory section 160 may be configured using memory regions of the ROM 112 and the RAM 113.

The control section 150 is provided with a detection control section 151, a measuring section 152, a drive control section 153, and a rotation control section 154. These sections are realized by executing a program using the main processor 111. The control device 110 may execute an operating system configuring a platform of an application program as a basic control program for controlling the sheet manufacturing apparatus 100. In this case, the functional sections of the control section 150 may be implemented as application programs.

FIG. 4 illustrates the first top sensor 311, the first bottom sensor 312, the second top sensor 315, and the second bottom sensor 316 as control target detection sections of the control section 150. The other sensors are collectively illustrated as sensors 300.

FIG. 4 illustrates the pressurizing roller drive section 341, the heating roller drive section 342, and the transport roller drive section 343 as control target drive sections of the control section 150. The other drive sections are collectively illustrated as drive sections 320.

The memory section 160 stores various data to be processed by the control section 150. For example, the memory section 160 stores basic setting data 161, measurement setting data 162, and speed setting data 163.

The basic setting data 161 is generated according to manipulation of the touch sensor 117 or based on commands and data input via a communication interface (not illustrated) provided in the control device 110 and the basic setting data 161 is stored in the memory section 160.

The basic setting data 161 contains various setting values and the like relating to the operations of the sheet manufacturing apparatus 100. For example, the basic setting data 161 contains setting values such as the number of sheets S to be manufactured by the sheet manufacturing apparatus 100, the type and color of the sheets S, the operating conditions of the parts of the sheet manufacturing apparatus 100, and the like. The basic setting data 161 contains a setting value input using the touch sensor 117 regarding the length of the fibers of the feedstock MA to be processed by the sheet manufacturing apparatus 100. For example, the feedstock MA is the sheet S manufactured by the sheet manufacturing apparatus 100 and may contain fibers processed a plurality of times by the sheet manufacturing apparatus 100, may contain fibers originating from broad-leaved trees, and the feedstock MA contains short fibers. The basic setting data 161 may contain a value input under an item relating to the length of the fibers of the feedstock MA such as the type of the feedstock MA as data of the length of the fibers of the feedstock MA.

The measurement setting data 162 contains parameters relating to the processes executed by the measuring section 152 and the rotation control section 154. For example, the measurement setting data 162 contains a setting number na, a reference value nc, a reference value nd, a first reference time S1, and a second reference time S2. Details of the parameters will be described later together with the operations of the control device 110.

The speed setting data 163 contains data for the control section 150 to control the speeds of the pressurizing roller drive section 341, the heating roller drive section 342, and the transport roller drive section 343. The speed setting data 163 contains speed setting values 164 and speed adjustment values 165. The speed setting values 164 contains parameters for the control section 150 to control, in a stepwise manner, the speeds of the pressurizing roller drive section 341, the heating roller drive section 342, and the transport roller drive section 343. The speed adjustment values 165 contains parameters for adjusting, in more fine sections, the speeds of the pressurizing roller drive section 341, the heating roller drive section 342, and the transport roller drive section 343.

FIG. 5 is a schematic diagram illustrating a configuration example of the speed setting values 164.

In the example illustrated in FIG. 5, the setting values of the rotation speeds R1, R2, and R3 are stored in the speed setting values 164 in association with each other.

In the example of FIG. 5, "Vp" is contained as the setting value of the rotation speed R1. The speed setting values 164 contain two stages of speed "Vhs" and "Vhf" as setting values of the rotation speed R2 of the heating rollers 86, where Vhf>Vhs. The rotation speed R1 of the pressurizing rollers 85 is fixed at Vp.

When the rotation speed R2 is the speed Vhs, transport speed V1>transport speed V2. When the rotation speed R2 is the speed Vhf, transport speed V1<transport speed V2.

The speed setting values 164 contain four stages of speed "Vc1", "Vc2", "Vc3", and "Vc4" as the setting values of the rotation speed R3 and Vc1<Vc2, Vc3<Vc4. The speeds Vc1 and Vc2 correspond to a case in which the rotation speed R2 is the speed Vhs. The speeds Vc3 and Vc4 correspond to a case in which the rotation speed R2 is the speed Vhf.

When the rotation speed R2 is the speed Vhs and the rotation speed R3 is the speed Vc1, transport speed V2>transport speed V3.

When the rotation speed R2 is the speed Vhs and the rotation speed R3 is the speed Vc2, transport speed V2<transport speed V3.

When the rotation speed R2 is the speed Vhf and the rotation speed R3 is the speed Vc3, transport speed V2>transport speed V3.

When the rotation speed R2 is the speed Vhf and the rotation speed R3 is the speed Vc4, transport speed V2<transport speed V3.

The control section 150 switches the rotation speed R2 and the rotation speed R3 in a stepwise manner by controlling the pressurizing roller drive section 341, the heating roller drive section 342, and the transport roller drive section 343 according to the speed setting values 164. Accordingly, it is possible to switch the magnitude relationship between the transport speeds V1, V2, and V3.

The detection control section 151 controls the detection by the sensors 300 and acquires the detection values of the sensors. For example, the detection control section 151 acquires the detection values of the first top sensor 311, the first bottom sensor 312, the second top sensor 315, and the second bottom sensor 316.

The measuring section 152 measures the time required for the movement of the first tension roller 811 based on the detection values of the first top sensor 311 and the first bottom sensor 312 detected by the detection control section 151. In more detail, the measuring section 152 measures the time required for the movement from the position P83 to the position P82.

The measuring section 152 measures the time required for the movement when the second tension roller 812 moves from the position P87 to the position P86 based on the detection values of the second top sensor 315 and the second bottom sensor 316 detected by the detection control section 151.

The measuring section 152 may measure the number of times the first tension roller 811 moves from the position P83 to the position P82, the number of times the first tension roller 811 moves from the position P82 to the position P83, the time required for the first tension roller 811 to move from the position P82 to the position P83, or the time required for the first tension roller 811 to move from the position P83 to the position P82. The measuring section 152 may measure the number of times the second tension roller 812 moves from the position P87 to the position P86, the number of times the second tension roller 812 moves from the position P86 to the position P87, the time required for the second tension roller 812 to move from the position P86 to the position P87, or the time required for the second tension roller 812 to move from the position P87 to the position P86.

By controlling the drive sections 320 based on the detection values of the sensors 300 acquired by the detection control section 151, the drive control section 153 operates the parts of the sheet manufacturing apparatus 100 according to the setting values of the basic setting data 161 and manufactures the sheet S.

The rotation control section 154 determines the rotation speeds R1, R2, and R3 based on the measurement results of the measuring section 152. The drive control section 153 controls the pressurizing roller drive section 341, the heating roller drive section 342, and the transport roller drive section 343 according to the rotation speeds R1, R2, and R3 set by the rotation control section 154.

The rotation control section 154 may determine the operational parameters of the pressurizing roller drive section 341, the heating roller drive section 342, and the transport roller drive section 343 according to the rotation speeds R1, R2, and R3. In this case, the drive control section 153 operates the pressurizing roller drive section 341, the heating roller drive section 342, and the transport roller drive section 343 using the operational parameters determined by the rotation control section 154.

Alternatively, the rotation control section 154 may determine the transport speeds V1, V2, and V3 based on the measurement results of the measuring section 152. In this case, the drive control section 153 drives the pressurizing roller drive section 341, the heating roller drive section 342, and the transport roller drive section 343 using the transport speeds V1, V2, and V3 determined by the rotation control section 154 as target values of the operation.

1-6. Operations of Sheet Manufacturing Apparatus

Figure 6:
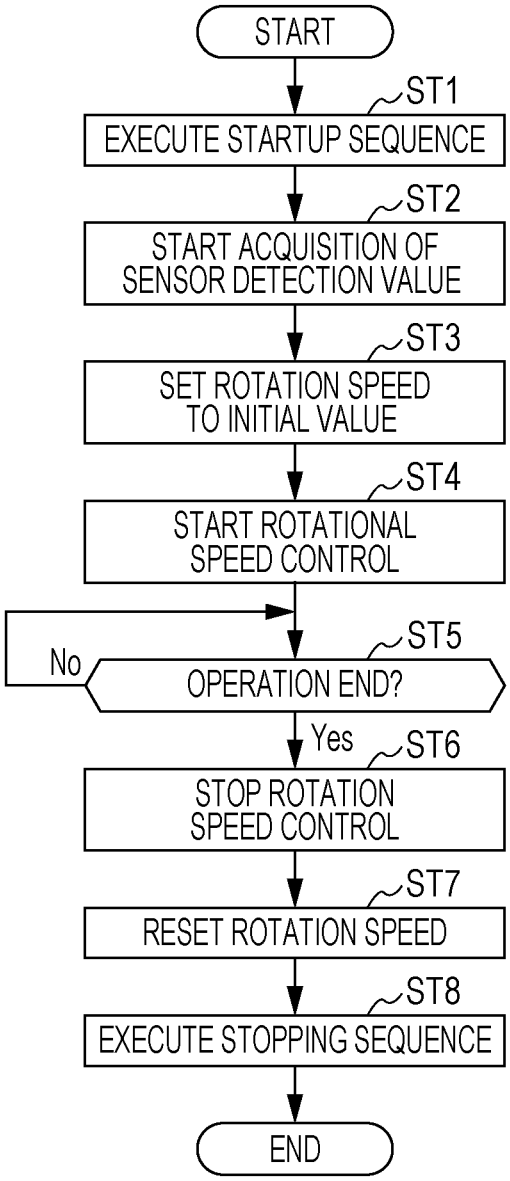
FIG. 6 is a flowchart illustrating operations of the sheet manufacturing apparatus.

FIG. 6 is a flowchart illustrating the operations of the sheet manufacturing apparatus 100.

The control section 150 executes a startup sequence using the functions of the detection control section 151 and the drive control section 153 (step ST1). In step ST1, the control section 150 executes the initialization of the sensors 300, the first top sensor 311, the first bottom sensor 312, the second top sensor 315, and the second bottom sensor 316. The control section 150 executes the initialization of the drive sections 320, the pressurizing roller drive section 341, the heating roller drive section 342, and the transport roller drive section 343 and causes the drive sections 320 to start up in a predetermined order.

The detection control section 151 starts the process of acquiring the detection values of the first top sensor 311, the first bottom sensor 312, the second top sensor 315, and the second bottom sensor 316 (step ST2). In step ST2, the control section 150 may start the process of acquiring the detection values of the sensors 300.

Next, the rotation control section 154 sets the rotation speeds R1, R2, and R3 to the initial values (step ST3). The drive control section 153 starts the operations of the pressurizing roller drive section 341, the heating roller drive section 342, and the transport roller drive section 343 according to the rotation speeds R1, R2, and R3 set in step ST3. The rotation control section 154 starts the rotation speed control (step ST4). The rotation speed control will be described later.

The control section 150 executes the manufacturing of the sheet S and determines whether or not the manufacturing is ended (step ST5). The control section 150 continues the manufacturing of the sheet S while the conditions to end the manufacturing are not satisfied (step ST5: NO).

In step ST5, the control section 150 performs a positive determination when the operation stopping is instructed by manipulation of the touch sensor 117, when the specified quantity of sheets S is manufactured, or the like. When the control section 150 determines that the conditions for ending the manufacturing are satisfied (step ST5: YES), the rotation control section 154 ends the rotation speed control (step ST6). The rotation control section 154 resets the rotation speeds R1, R2, and R3 to the initial values (step ST7). Subsequently, the control section 150 executes the stopping sequence (step ST8). In step ST8, the drive control section 153 stops the drive sections 320, the pressurizing roller drive section 341, the heating roller drive section 342, and the transport roller drive section 343 in a predetermined order.

Figure 7:
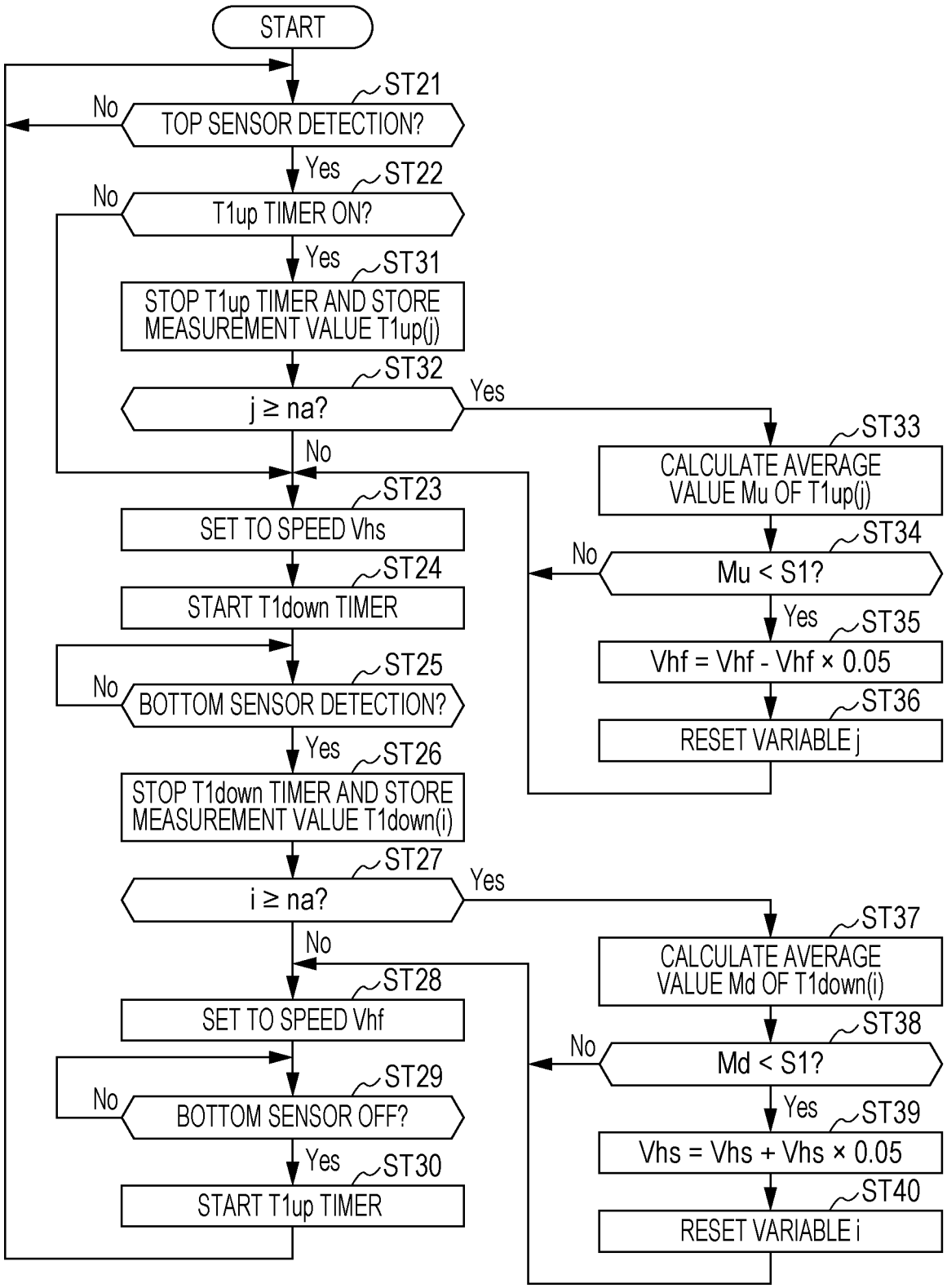
FIG. 7 is a flowchart illustrating operations of the sheet manufacturing apparatus.
Figure 8:
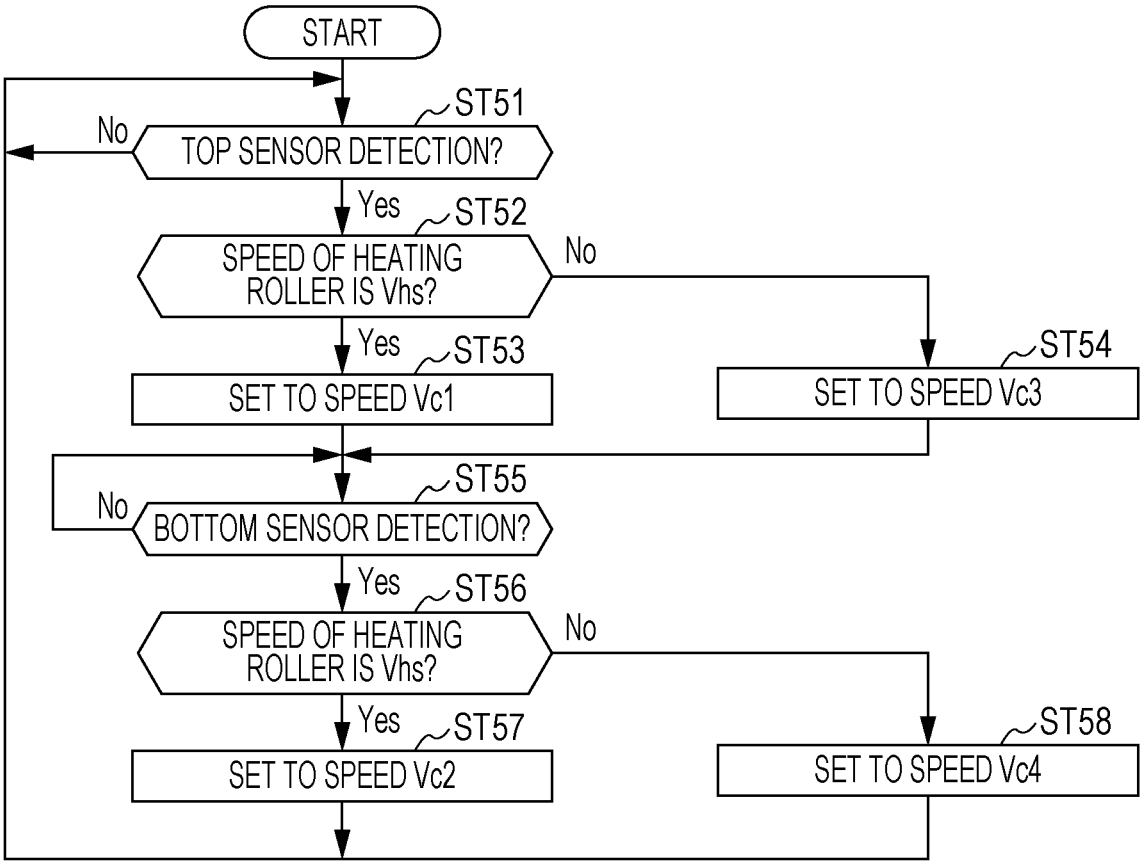
FIG. 8 is a flowchart illustrating operations of the sheet manufacturing apparatus.

FIGS. 7 and 8 are flowcharts illustrating the operations of the sheet manufacturing apparatus 100 and particularly illustrate the operations relating to the rotation speed control. FIG. 7 illustrates the control relating to the rotation speed R2 of the heating rollers 86 and FIG. 8 illustrates the control relating to the rotation speed R3 of the transport rollers 89.

A description will be given of an outline of the rotation speed control of the heating rollers 86.

The initial values of the transport speed V1 and the transport speed V2 are set such that transport speed V1>transport speed V2. In this case, the rotation speed R2 may be the speed Vhs set in the speed setting values 164 of FIG. 5 and may be another speed. When the transporting of the second web W2 and the pressurized sheet SS1 is started by the pressurizing section 82 and the heating section 84, since transport speed V1>transport speed V2, the length of the pressurized sheet SS1 in the first buffer portion 801 gradually becomes longer. The first tension roller 811 moves in the D direction in accordance with the elongation of the pressurized sheet SS1 in the first buffer portion 801 and the first bottom sensor 312 detects the first tension roller 811. Since the rotation control section 154 uses the detection as a trigger to shorten the pressurized sheet SS1 in the first buffer portion 801, the rotation control section 154 switches the rotation speed R2 to the speed Vhf of the speed setting values 164. Since transport speed V1<transport speed V2 due to this switching, the pressurized sheet SS1 in the first buffer portion 801 is shortened. The first tension roller 811 moves in the U direction in accordance with the shortening of the pressurized sheet SS1 and the first top sensor 311 detects the first tension roller 811. Since the rotation control section 154 uses the detection of the first top sensor 311 as a trigger to lengthen the pressurized sheet SS1 in the first buffer portion 801, the rotation control section 154 switches the rotation speed R2 to the speed Vhs which is the low speed.

In this manner, the rotation control section 154 maintains the length of the pressurized sheet SS1 in the first buffer portion 801 within a predetermined range by switching the rotation speed R2 of the heating rollers 86 between low speed and high speed in a stepwise manner.

The rotation control section 154 sets the speed of the rotation speed R2 to the initial value in step ST3 of FIG. 6. The initial value is set to the speed Vhf, for example. Since transport speed V1<transport speed V2 when the rotation speed R2 is set to Vhf, the first tension roller 811 moves in the U direction.

The measuring section 152 determines whether or not the first top sensor 311 detects the first tension roller 811 based on the detection value acquired from the first top sensor 311 by the detection control section 151 (step ST21). When the first top sensor 311 does not detect the first tension roller 811 (step ST21: NO), the measuring section 152 waits.

When the first top sensor 311 detects the first tension roller 811 (step ST21: YES), the measuring section 152 determines whether or not a T1up timer is performing a count (step ST22). The T1up timer is a timer for measuring the time over which the measuring section 152 executes. When the process of step ST22 is first executed, since the T1up timer is not performing a count (step ST22: NO), the control section 150 transitions to step ST23.

In step ST23, the rotation control section 154 refers to the speed setting values 164 and sets the rotation speed R2 to the speed Vhs (step ST23). Accordingly, the drive control section 153 modifies the operation speed of the heating roller drive section 342 such that transport speed V1>transport speed V2. Here, the measuring section 152 starts the count of a T1down timer (step ST24). The T1down timer is a timer which counts the time in which the first tension roller 811 moves from the position P82 to the position P83.

The measuring section 152 determines whether or not the first bottom sensor 312 detects the first tension roller 811 based on the detection value of the first bottom sensor 312 acquired by the detection control section 151 (step ST25). When the first bottom sensor 312 does not detect the first tension roller 811 (step ST25: NO), the measuring section 152 waits at step ST25.

When the first bottom sensor 312 detects the first tension roller 811 (step ST25: YES), the measuring section 152 stops the T1down timer and temporarily stores the count value of the T1down timer in the control section 150 (step ST26). In step ST26, the count value of the T1down timer is stored as a measurement value T1down(i). Here, "i" is a variable indicating an execution number of the counts of the T1down timer and the measuring section 152 adds 1 to the value of the execution number i every time the T1down timer starts a count.

The rotation control section 154 determines whether or not the value of the execution number i of the T1down timer reaches the setting number na (step ST27). When the execution number i reaches the setting number na (step ST27: YES), the rotation control section 154 transitions to step ST37. The processes of step ST37 onward will be described later.

When the execution number i does not reach the setting number na (step ST27: NO), the rotation control section 154 refers to the speed setting values 164 and sets the rotation speed R2 to the speed Vhf (step ST28). Accordingly, the drive control section 153 modifies the operation speed of the heating roller drive section 342 such that transport speed V1<transport speed V2.

The measuring section 152 determines whether or not the first bottom sensor 312 no longer detects the first tension roller 811 based on the detection value of the first bottom sensor 312 (step ST29). While the first bottom sensor 312 is detecting the first tension roller 811 (step ST29: NO), the measuring section 152 waits. When the first bottom sensor 312 no longer detects the first tension roller 811 (step ST29: YES), the measuring section 152 starts the count of the T1up timer (step ST30) and returns to step ST21. The T1up timer is a timer which counts the time in which the first tension roller 811 moves from the position P83 to the position P82.

Subsequently, the control section 150 executes steps ST21 to ST22.

When the measuring section 152 determines that the first top sensor 311 detects the first tension roller 811 (step ST21: YES) and determines that the count of the T1up timer is being executed (step ST22: YES), the measuring section 152 transitions to step ST31. In step ST31, the measuring section 152 stops the count of the T1up timer and stores the count value in the control section 150 (step ST31). In step ST31, the count value of the T1up timer is stored as T1up (j). Here, "j" is a variable indicating an execution number of the counts of the T1up timer and the measuring section 152 adds 1 to the value of the execution number j every time the T1up timer starts a count.

The rotation control section 154 determines whether or not the value of the execution number j of the T1up timer reaches the setting number na (step ST32). When the execution number j is yet to reach the setting number na (step ST32: NO), the rotation control section 154 transitions to step ST23.

When the execution number j reaches the setting number na (step ST32: YES), the rotation control section 154 calculates an average value Mu of T1up (j) stored in the control section 150 (step ST33). The average value Mu is the average of the time required for the movement of the first tension roller 811 when the operation of the first tension roller 811 moving from the position P83 to the position P82 is executed j times.

The rotation control section 154 compares the average value Mu to the first reference time S1 (step ST34) and transitions to step ST23 when the average value Mu is greater than or equal to the first reference time S1 (step ST34: NO).

When the average value Mu is smaller than the first reference time S1 (step ST34: YES), the rotation control section 154 modifies the value of Vhf of the speed setting values 164 (step ST35). In step ST35, the rotation control section 154 executes the process of Equation (1) below.

$$Vhf = Vhf - Vhf \times 0.05 \quad (1)$$

The process of Equation (1) is a process of reducing the value of Vhf by 5%. In step ST35, the rotation control section 154 may overwrite the values of the speed setting values 164 stored by the control section 150 and may temporarily update the value of Vhf of the speed setting values 164 such that it is possible to restore Vhf to the pre-update value.

The rotation control section 154 resets the execution number j (step ST36) and transitions to step ST23.

According to the processes of steps ST33 to ST36, the rotation control section 154 lowers the speed Vhf in a case in which the average value Mu of the movement time when the first tension roller 811 moves from the position P83 to the position P82 is shorter than the first reference time S1. Accordingly, the difference between the transport speed V2 and the transport speed V1 when the rotation speed R2 of the heating rollers 86 is set to the high speed Vhf shrinks. Therefore, when transport speed V1<transport speed V2, there is an effect of lengthening the time in which the first tension roller 811 moves from the position P83 to the position P82. Therefore, it is possible to reduce the speed of the movement of the first tension roller 811 and stabilize the operation of the sheet manufacturing apparatus 100.

The time in which the first tension roller 811 moves between the first top sensor 311 and the first bottom sensor 312 being short means that the pressurized sheet SS1 is displaced at high speed in the first buffer portion 801. Since this state has great fluctuation in the tension applied to the pressurized sheet SS1, the state is not preferable from the perspective of stabilizing the manufacturing quality of the sheet S. Since the frequency at which the rotation control section 154 modifies the rotation speed R2 is high, this is not preferable since the operation of the sheet manufacturing apparatus 100 does not easily stabilize. In this case, it is possible to reduce the speed of the movement of the first tension roller 811 and stabilize the operation of the sheet manufacturing apparatus 100 through the rotation control section 154 modifying the speed Vhf serving as the setting value of the rotation speed R2.

The proportion by which to reduce the speed Vhf in the process of step ST35 is stored contained in the basic setting data 161 or the measurement setting data 162, for example. The proportion is arbitrary and "5%" depicted in FIG. 7 is merely an example. It is preferable that the proportion be smaller than the difference between the speed Vhf and the speed Vhs, and it is possible to set the proportion to less than or equal to 10%, for example.

The rotation control section 154 also executes a similar process for the speed Vhs.

The rotation control section 154 determines whether or not the value of the execution number i of the T1down timer reaches the setting number na (step ST27). When the execution number i reaches the setting number na (step ST28: YES), an average value Md of T1down(i) stored in the control section 150 is calculated (step ST37). The average value Md is the average of the time required for the movement of the first tension roller 811 when the operation of the first tension roller 811 moving from the position P82 to the position P83 is executed i times.

The rotation control section 154 compares the average value Md to the first reference time S1 (step ST38) and transitions to step ST28 when the average value Md is greater than or equal to the first reference time S1 (step ST38: NO).

When the average value Md is smaller than the first reference time S1 (step ST38: YES), the rotation control section 154 modifies the value of Vhs of the speed setting values 164 (step ST39). In step ST35, the rotation control section 154 executes the process of Equation (2) below.

$$Vhs=Vhs+Vhs\times 0.05 \quad (2)$$

The process of Equation (2) is a process of increasing the value of Vhs by 5%. In step ST39, the rotation control section 154 may overwrite the value of the speed setting values 164 stored by the control section 150 and may temporarily update the value of Vhs of the speed setting values 164 such that it is possible to restore Vhs to the pre-update value.

The rotation control section 154 resets the execution number i (step ST40) and transitions to step ST28.

According to the processes of steps ST37 to ST39, the rotation control section 154 increases the speed Vhs in a case in which the average value Md of the movement time when the first tension roller 811 moves from the position P82 to the position P83 is shorter than the first reference time S1. Accordingly, the difference between the transport speed V2 and the transport speed V1 when the rotation speed R2 of the heating rollers 86 is set to the low speed Vhs shrinks. Accordingly, when transport speed V1>transport speed V2, there is an effect of lengthening the time in which the first tension roller 811 moves from the position P82 to the position P83. Therefore, it is possible to reduce the speed of the movement of the first tension roller 811 and stabilize the operation of the sheet manufacturing apparatus 100.

The proportion by which to reduce the speed Vhs in the process of step ST39 is stored contained in the basic setting data 161 or the measurement setting data 162, for example. The proportion is arbitrary and "5%" depicted in FIG. 7 is merely an example. It is preferable that the proportion be smaller than the difference between the speed Vhf and the speed Vhs, and it is possible to set the proportion to less than or equal to 10%, for example.

In step ST27 and step ST32, the operation of comparing the execution numbers i and j to the common setting number na is an example and the execution number i and the execution number j may be compared to different setting values. The number of setting numbers na is arbitrary.

In step ST34 and step ST38, the operation of comparing the average value Mu and the average value Md to the common first reference time S1 is an example and the average value Mu and the average value Md may be compared to different reference times. The value of the first reference time S1 is arbitrary.

The rotation control section 154 is capable of executing the control relating to the rotation speed R3 illustrated in FIG. 8 independently from the control relating to the rotation speed R2 illustrated in FIG. 7.

The rotation control section 154 determines whether or not the second top sensor 315 detects the second tension roller 812 based on the detection value of the second top sensor 315 acquired by the detection control section 151 (step ST51). When the second top sensor 315 does not detect the second tension roller 812 (step ST51: NO), the rotation control section 154 waits.

When the second top sensor 315 detects the second tension roller 812 (step ST51: YES), the rotation control section 154 determines whether or not the rotation speed R2 of the heating rollers 86 positioned upstream is set to the speed Vhs (step ST52). In the present embodiment, the rotation speed R2 is set to two stages of the speed Vhs and the speed Vhf. When the rotation speed R2 is set to the speed Vhs (step ST52: YES), the rotation control section 154 sets the rotation speed R3 to the speed Vc1 (step ST53). When the rotation speed R2 is not set to the speed Vhs (step ST52: NO), since the rotation speed R2 is the speed Vhf, the rotation control section 154 sets the rotation speed R3 to the speed Vc3 (step ST54). The drive control section 153 modifies the operation speed of the transport roller drive section 343 according to the process of the rotation control section 154 of steps ST53 and ST54.

Subsequently, the rotation control section 154 determines whether or not the second bottom sensor 316 detects the second tension roller 812 (step ST55). When the second bottom sensor 316 does not detect the second tension roller 812 (step ST55: NO), the rotation control section 154 waits.

When the second bottom sensor 316 detects the second tension roller 812 (step ST55: YES), the rotation control section 154 determines whether or not the rotation speed R2 of the heating rollers 86 positioned upstream is set to the speed Vhs (step ST56). When the rotation speed R2 is set to the speed Vhs (step ST56: YES), the rotation control section 154 sets the rotation speed R3 to the speed Vc2 (step ST57). When the rotation speed R2 is not set to the speed Vhs (step ST56: NO), since the rotation speed R2 is the speed Vhf, the rotation control section 154 sets the rotation speed R3 to the speed Vc4 (step ST58). The drive control section 153 modifies the operation speed of the transport roller drive section 343 according to the process of the rotation control section 154 of steps ST57 and ST58.

As described above, the sheet manufacturing apparatus 100 serving as the transporting apparatus is provided with the pressurizing rollers 85 which transport the web-like or sheet-like transport target object FM and the heating rollers 86 which are disposed downstream of the pressurizing rollers 85 in the transport path FW. The sheet manufacturing apparatus 100 is provided with the first bottom sensor 312 disposed between the pressurizing rollers 85 and the heating rollers 86 in the transport path FW and provided on one side in of the transport path FW and the first top sensor 311 provided on the other side of the transport path FW. The sheet manufacturing apparatus 100 is provided with the measuring section 152 which measures the time from when the transport target object FM is detected by the first bottom sensor 312 until the transport target object FM is detected by the first top sensor 311. The sheet manufacturing apparatus 100 is provided with the rotation control section 154 which modifies the rotation speed of the heating rollers 86 when the time measured by the measuring section 152 is shorter than the first reference time S1.

Expressed in different terms, the first bottom sensor 312 and the first top sensor 311 are disposed between the pressurizing rollers 85 and the heating rollers 86 in the transport path FW of the sheet manufacturing apparatus 100 and are disposed to face each other in a direction intersecting the transport path FW.

The sheet manufacturing apparatus 100 executes a transporting method including a first step and a second step. In the first step, a time from when the transport target object FM is detected by the first bottom sensor 312 until the transport target object FM is detected by the first top sensor 311 is measured. In the second step, the rotation speed of the heating rollers 86 is modified when the time measured in the first step is shorter than the first reference time S1.

The sheet manufacturing apparatus 100 serving as the fibrous feedstock recycling apparatus is provided with the forming section 101 which forms the transport target object FM serving as the processing target object from the feedstock MA containing the fibers. The sheet manufacturing apparatus 100 includes the cutting section 90 serving as the processing section which processes the transport target object FM. The sheet manufacturing apparatus 100 also includes the molding section 80 and the pre-cutting transport section 88 which serve as the transport section that transports the processing target object from the forming section 101 to the cutting section 90. The sheet manufacturing apparatus 100 is provided with the pressurizing rollers 85 which transport the transport target object FM and the heating rollers 86 which are disposed downstream of the pressurizing rollers 85 in the transport path FW. The sheet manufacturing apparatus 100 is provided with the first bottom sensor 312 disposed between the pressurizing rollers 85 and the heating rollers 86 in the transport path FW and provided on one side in of the transport path FW and the first top sensor 311 provided on the other side of the transport path FW. The sheet manufacturing apparatus 100 is provided with the measuring section 152 which measures the time from when the transport target object FM is detected by the first bottom sensor 312 until the transport target object FM is detected by the first top sensor 311. The sheet manufacturing apparatus 100 is provided with the rotation control section 154 which modifies the rotation speed of the heating rollers 86 when the time measured by the measuring section 152 is shorter than the first reference time S1.

In the embodiment, the first roller is the pressurizing rollers 85, the second roller is the heating rollers 86, and the first top sensor 311 and the first bottom sensor 312 are disposed in the first buffer portion 801 between the pressurizing rollers 85 and the heating rollers 86. The transport target object FM is the second web W2 and the pressurized sheet SS1. The molding section 80 serves as the transport section to transport the transport target object FM. The first tension roller 811 corresponds to a moving member.

Accordingly, when the transport target object FM is transported by the pressurizing rollers 85 and the heating rollers 86, it is possible to adjust the speed difference between the transport speed V1 of the pressurizing rollers 85 and the transport speed V2 of the heating rollers 86. Accordingly, for example, it is possible to adjust the speed difference between the transport speed V1 and the transport speed V2 such that the speed of the displacement of the transport target object FM in the first buffer portion 801 falls within an appropriate range and it is possible to stabilize the transport target object FM during transport.

In the sheet manufacturing apparatus 100, the first bottom sensor 312 is disposed to one side of the transport path FW in the vertical direction and the first top sensor 311 is installed on the opposite side from the first bottom sensor 312 in the transport path FW.

The sheet manufacturing apparatus 100 is provided with the first tension roller 811 which is disposed between the pressurizing rollers 85 and the heating rollers 86 in the transport path FW and moves in response to the displacement of the transport target object FM. The first detection section is the first bottom sensor 312 which detects the first tension roller 811. The second detection section is the first top sensor 311 which detects the first tension roller 811. The first top sensor 311 and the first bottom sensor 312 detect the transport target object FM by detecting the first tension roller 811. Accordingly, it is possible to reliably detect the position of the transport target object FM at high precision.

When the first tension roller 811 which is the moving member is configured to come into contact with the transport target object FM and moves in response to the displacement of the transport target object FM, it is possible to suppress the slack of the transport target object FM using the first tension roller 811 and to more stably transport the transport target object FM.

The rotation control section 154 executes stepwise control in which the speed of the heating rollers 86 is modified in a stepwise manner. For example, the rotation speed R2 of the heating rollers 86 is set to one of the speed Vhs and the speed Vhf set in the speed setting values 164. The rotation control section 154 modifies the rotation speed of the heating rollers 86 by a smaller change amount than the stepwise control when the time measured by the measuring section 152 is shorter than the first reference time S1. For example, the rotation control section 154 changes each of the speed Vhs and the speed Vhf by 5%.

Accordingly, it is possible to adjust the speed difference between the transport speed V1 and the transport speed V2 by a smaller change amount than the stepwise control when performing the stepwise control in which the magnitude relationship between the transport speed V1 and the transport speed V2 is switched in a stepwise manner and the transport target object FM is transported. It is possible to still further stabilize the transport target object FM by making minute adjustments to the speed difference between the transport speed V1 and the transport speed V2.

The first bottom sensor 312 is disposed so as to correspond to the position of the transport target object FM when the length of the transport target object FM between the pressurizing rollers 85 and the heating rollers 86 is a predetermined length. The first top sensor 311 is disposed so as to correspond to the position of the transport target object FM when the length of the transport target object FM between the pressurizing rollers 85 and the heating rollers 86 is shorter than a predetermined length. The position of the transport target object FM is the position of the transport target object FM when the first tension roller 811 is at the position P83, for example. The first top sensor 311 is disposed so as to correspond to the position of the transport target object FM when the length of the transport target object FM between the pressurizing rollers 85 and the heating rollers 86 is shorter than a predetermined length. The position of the transport target object FM is a position shifted further to the D side than the position P81 and is the position of the transport target object FM when the first tension roller 811 is at the position P82. The rotation control section 154 sets the rotation speed of the heating rollers 86 to a first speed when the transport target object FM is detected by the first bottom sensor 312. The rotation control section 154 sets the rotation speed of the heating rollers 86 to a second speed which is a lower speed than the first speed when the transport target object FM is detected by the first top sensor 311. The first speed is the speed Vhf, for example, and the second speed is the speed Vhs, for example. The rotation control section 154 modifies one or both of the first speed and the second speed when the time T1up (j) measured by the measuring section 152 is shorter than the first reference time S1. In the embodiment, a process of reducing the speed Vhf which is the first speed by 5% in step ST35 and a process of increasing the speed Vhs which is the second speed by 5% in step ST39 are performed.

In this configuration, the rotation control section 154 modifies the rotation speed R2 to the first speed such that the transport target object FM is shortened when the length of the transport target object FM in the first buffer portion 801 is a predetermined length. When the transport target object FM is shorter than the predetermined length, the rotation control section 154 performs control in which the rotation speed R2 is modified to the second speed such that the transport target object FM is lengthened. The sheet manufacturing apparatus 100 prevents the application of excessive tension to the transport target object FM and excessive slack in the transport target object FM by causing the length of the transport target object FM to fluctuate. Since the rotation control section 154 modifies the speeds Vhs and Vhf when the time T1up (j) measured by the measuring section 152 is shorter than the first reference time S1, it is possible to keep the speed of the fluctuation in the length of the transport target object FM within an appropriate range, for example. Accordingly, it is possible to still further stabilize the transport target object FM.

The change amount by which the rotation control section 154 changes the speed Vhf which is the first speed is not limited to 5%, it is possible to set the change amount arbitrarily within a range in which the change amount is smaller than the difference between the speed Vhs and the speed Vhf. Similarly, the change amount by which the rotation control section 154 changes the speed Vhs which is the second speed is not limited to 5%, it is possible to set the change amount arbitrarily within a range in which the change amount is smaller than the difference between the speed Vhs and the speed Vhf.

Restrictions may be put on the cumulative change amount of the speed Vhf when step ST35 is executed a plurality of times. For example, when step ST35 is executed, a restriction may be put on the cumulative change amount of the speed Vhf so as to not exceed a range of ±10% of the speed Vhf before executing the operations of FIG. 7. In this case, the rotation control section 154 modifies the speed Vhf within a range not departing from a range of ±10% from the initial value of the speed Vhf before executing the operations of FIG. 7. Similarly, restrictions may be put on the cumulative change amount of the speed Vhs when step ST39 is executed a plurality of times. For example, when step ST39 is executed, a restriction may be put on the cumulative change amount of the speed Vhs so as to not exceed a range of ±10% of the speed Vhs before executing the operations of FIG. 7. In this case, the rotation control section 154 modifies the speed Vhs within a range not departing from a range of ±10% from the initial value of the speed Vhs before executing the operations of FIG. 7. The restrictions of the change amount between the speed Vhs and the speed Vhf may be defined using the speed difference between the transport speed V1 and the transport speed V2. In other words, the value of the speed Vhf may be restricted such that the relationship of transport speed V1>transport speed V2 is maintained or such that the transport speed V2 becomes a higher speed than the transport speed V1 by greater than or equal to 10%. Similarly, the value of the speed Vhs may be restricted such that the relationship of transport speed V1<transport speed V2 is maintained or such that the transport speed V2 becomes a lower speed than the transport speed V1 by greater than or equal to 10%.

The measurement of the time T1up (j) required for the operations from when the transport target object FM is detected by the first bottom sensor 312 until the transport target object FM is detected by the first top sensor 311 is repeatedly executed by the measuring section 152 until j=setting number na. The rotation control section 154 compares the average value Mu of the measured times T1up (j) by the measuring section 152 to the first reference time S1. In the embodiment, the setting number na is greater than or equal to 2.

Accordingly, it is possible to suppress the frequency of the modification of the rotation speed R2 and it is possible to prevent destabilization of the transporting of the transport target object FM caused by fluctuations in the rotation speed R2 and to more stably transport the transport target object FM.

In the embodiment, the first roller is the pressurizing rollers 85 which pressurize the second web W2 serving as the transport target object FM. In this configuration, by performing a process of pressurizing the second web W2 and modifying the rotation speed R2 of the heating rollers 86 downstream of the pressurizing rollers 85, it is possible to stably transport the pressurized sheet SS1 that is pressurized.

The second roller is the heating rollers 86 which heat the pressurized sheet SS1 serving as the processing target object. In this configuration, by modifying the rotation speed R2 of the heating rollers 86, it is possible to stabilize the transporting of the pressurized sheet SS1 between the pressurizing rollers 85 which pressurize the second web W2 and the heating rollers 86 which heat the pressurized sheet SS1.

2. Second Embodiment

Hereinafter, a description will be given of the second embodiment.

In the first embodiment, a description will be given of a configuration in which the setting number na is set in advance and is stored in the memory section 160 as the measurement setting data 162. In the second embodiment, a description will be given of an example in which a process in which the rotation control section 154 modifies the setting number na when the measuring section 152, the speed setting data 163, and the rotation control section 154 perform similar operations to those of the first embodiment.

In the second embodiment, since the configuration of the sheet manufacturing apparatus 100 is shared with that of the first embodiment, illustration and description thereof will be omitted. The operations of the sheet manufacturing apparatus 100 are executed in the same manner as in the first embodiment except for the operations illustrated in FIG. 9.

Figure 9:
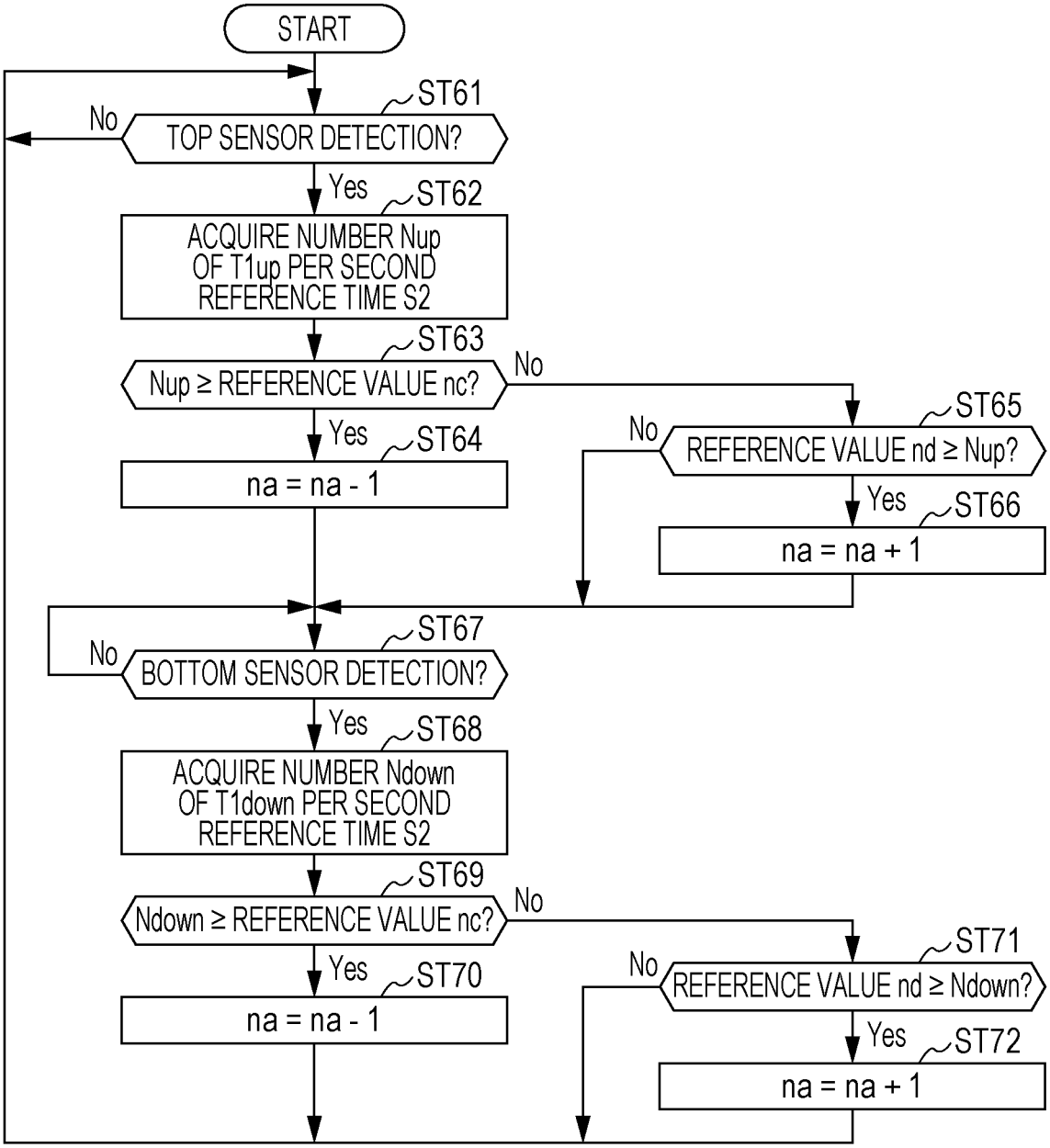
FIG. 9 is a flowchart illustrating operations of a sheet manufacturing apparatus of a second embodiment.

FIG. 9 is a flowchart illustrating the operations of the sheet manufacturing apparatus 100 of the second embodiment. In the operations illustrated in FIG. 9, the control section 150 refers to the reference value nc and the reference value nd stored by the memory section 160.

The rotation control section 154 determines whether or not the first top sensor 311 detects the first tension roller 811 based on the detection value acquired from the first top sensor 311 by the detection control section 151 (step ST61). When the first top sensor 311 does not detect the first tension roller 811 (step ST61: NO), the rotation control section 154 waits.

When the first top sensor 311 detects the first tension roller 811 (step ST61: YES), the rotation control section 154 performs determination relating to the number of times that the measuring section 152 performs counting using the T1up timer (step ST62). In other words, in step ST62, the rotation control section 154 obtains the count execution number of the T1up timer per second reference time S2 and uses the count execution number as a number Nup (step ST62).

The rotation control section 154 compares the number Nup to the reference value nc and determines whether or not the number Nup is greater than or equal to the reference value nc (step ST63). When the number Nup is greater than or equal to the reference value nc (step ST63: YES), the rotation control section 154 subtracts 1 from the value of the setting number na, updates the setting number na stored by the memory section 160 (step ST64), and transitions to step ST67.

When the number Nup is smaller than the reference value nc (step ST63: NO), the rotation control section 154 determines whether or not the number Nup is less than or equal to the reference value nd (step ST65). When the number Nup is less than or equal to the reference value nd (step ST65: YES), the rotation control section 154 adds 1 to the value of the setting number na, updates the setting number na stored by the memory section 160 (step ST66), and transitions to step ST67.

When the number Nup is greater than the reference value nd (step ST65: NO), the rotation control section 154 transitions to step ST67.

In step ST67, the rotation control section 154 determines whether or not the first bottom sensor 312 detects the first tension roller 811 based on the detection value of the first bottom sensor 312 (step ST67). When the first bottom sensor 312 does not detect the first tension roller 811 (step ST67: NO), the rotation control section 154 waits.

When the first bottom sensor 312 detects the first tension roller 811 (step ST67: YES), the rotation control section 154 performs determination relating to the number of times that the measuring section 152 performs counting using the T1down timer (step ST68). In other words, in step ST68, the rotation control section 154 obtains the count execution number of the T1down timer per second reference time S2 and uses the count execution number as a number Ndown (step ST69).

The rotation control section 154 compares the number Ndown to the reference value nc and determines whether or not the number Ndown is greater than or equal to the reference value nc (step ST69). When the number Ndown is greater than or equal to the reference value nc (step ST69: YES), the rotation control section 154 subtracts 1 from the value of the setting number na, updates the setting number na stored by the memory section 160 (step ST70), and returns to step ST61.

When the number Ndown is smaller than the reference value nc (step ST69: NO), the rotation control section 154 determines whether or not the number Ndown is less than or equal to the reference value nd (step ST71). When the number Ndown is less than or equal to the reference value nd (step ST71: YES), the rotation control section 154 adds 1 to the value of the setting number na, updates the setting number na stored by the memory section 160 (step ST72), and returns to step ST61.

When the number Ndown is greater than the reference value nd (step ST71: NO), the rotation control section 154 transitions to step ST61.

In steps ST64, ST66, ST70, and ST72, the value obtained by updating the setting number na may be stored separately from the initial value of the setting number na in the measurement setting data 162 stored by the memory section 160. In this case, it is possible to restore the value of the setting number na to the value from before the processes of FIG. 9 are executed.

In this manner, according to the sheet manufacturing apparatus 100 of the second embodiment, the rotation control section 154 is capable of modifying the setting number na. The setting number na determines the frequency at which the average value Mu of the measurement value T1up (j) of the T1up timer is compared to the first reference time S1. The setting number na also determines the frequency at which the average value Md of the measurement value T1down(i) of the T1down timer is compared to the first reference time S1. Therefore, it is possible to modify the frequency at which the speeds Vhf and Vhs are modified by modifying the setting number na. For example, when the frequency of the displacement of the transport target object FM in the U-D directions is low, it is possible to lower the frequency at which the speeds Vhf and Vhs are modified. In this case, when the operations of the transport target object FM are stable, it is possible to reduce the frequency of the processing by the rotation control section 154 to obtain an improvement in processing efficiency. For example, when the frequency of the displacement of the transport target object FM in the U-D directions is high, it is possible to increase the frequency at which the speeds Vhf and Vhs are modified. In this case, when the operations of the transport target object FM exhibit an unstable tendency, it is possible to increase the frequency of the processing by the rotation control section 154 to obtain stabilization of the transport target object FM.

Specifically, the rotation control section 154 modifies the setting number na based on the number of times the operation of the transport target object FM being detected by the first top sensor 311 after the transport target object FM is detected by the first bottom sensor 312 within the second reference time S2. Accordingly, it is possible to adjust the frequency at which the speeds Vhf and Vhs are modified according to the frequency of the displacement of the transport target object FM in the U-D directions.

In FIG. 9, although an example is described in which Nup and Ndown are compared to the reference value nc and the reference value nd which are common, the configuration is not limited to this example. For example, the rotation control section 154 may store each of the reference value to be compared to Nup and the reference value to be compared to Ndown as different reference values in the memory section 160. The range in which to modify the setting number na in steps ST64, ST66, ST70, and ST72 is not limited to being +1 and −1 and the modification may be made in a wider range. The specific time of the second reference time S2 is arbitrary.

Although the operations of FIG. 9 apply to the setting number na when using a shared setting number na for the measurement value T1down(i) of the T1down timer and the measurement value T1up (j) of the T1up timer in the operations of FIG. 7, the configuration is not limited to this example. It is possible to apply the operations of FIG. 9 even when using different setting numbers for the measurement value T1down(i) of the T1down timer and the measurement value T1up (j) of the T1up timer. In this case, each of the setting number relating to the measurement value T1down(i) of the T1down timer and the setting number relating to the measurement value T1up (j) of the T1up timer may be used as a target to execute the operations of FIG. 9.

3. Third Embodiment

Hereinafter, a description will be given of the third embodiment.

In the first embodiment, a description is given of an example in which the speeds Vc1 to Vc4 are switched and set based on the speed setting values 164 for the rotation speed R3 of the pre-cutting transport section 88. In the third embodiment, a description will be given of an example in which the rotation control section 154 modifies the rotation speed R3 based on the time of the operation from when the second tension roller 812 is detected by the second bottom sensor 316 until the second tension roller 812 is detected by the second top sensor 315. In other words, in the third embodiment, instead of the operations described in FIG. 8, the operations illustrated in FIG. 10 are executed by the sheet manufacturing apparatus 100.

In the third embodiment, since the configuration of the sheet manufacturing apparatus 100 is shared with that of the first embodiment, illustration and description thereof will be omitted. The operations of the sheet manufacturing apparatus 100 are executed in the same manner as in the first embodiment except for the operations illustrated in FIGS. 8 and 10.

Figure 10:
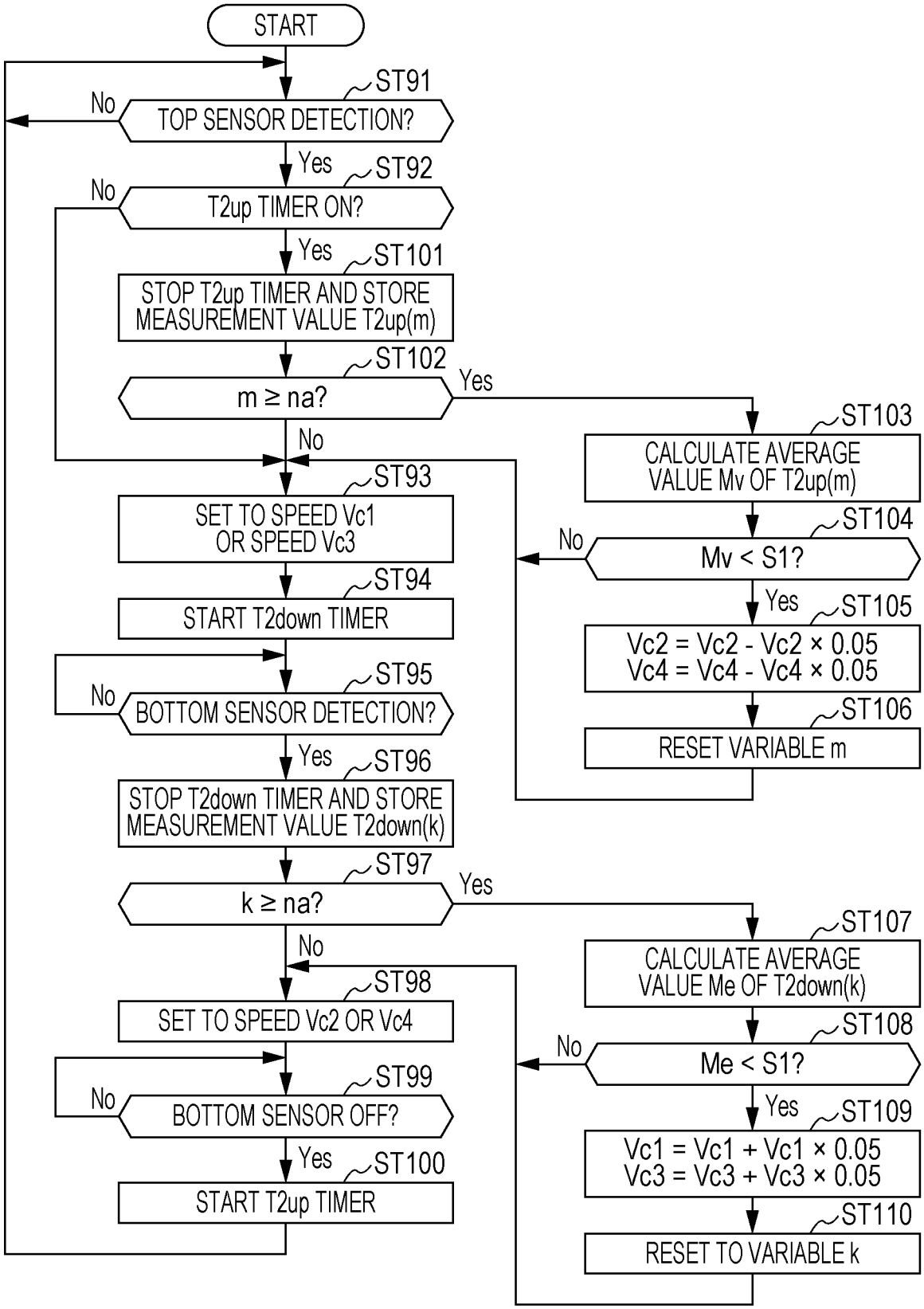
FIG. 10 is a flowchart illustrating operations of a sheet manufacturing apparatus of a third embodiment.

FIG. 10 is a flowchart illustrating the operations of the sheet manufacturing apparatus 100 of the third embodiment.

The rotation control section 154 sets the rotation speed R3 to the initial value. The initial value is a speed at which transport speed V2<transport speed V3, for example. Specifically, the initial value is the speed Vc4 when the rotation speed R2 is the speed Vhf and the initial value is the speed Vc2 when the rotation speed R2 is the speed Vhs.

The measuring section 152 determines whether or not the second top sensor 315 detects the second tension roller 812 based on the detection value acquired from the second top sensor 315 by the detection control section 151 (step ST91). When the second top sensor 315 does not detect the second tension roller 812 (step ST91: NO), the measuring section 152 waits.

When the second top sensor 315 detects the second tension roller 812 (step ST91: YES), the measuring section 152 determines whether or not a T2up timer is performing a count (step ST92). The T2up timer is a timer for measuring the time over which the measuring section 152 executes. When the process of step ST92 is first executed, since the T2up timer is not performing a count (step ST92: NO), the control section 150 transitions to step ST93.

In step ST93, the rotation control section 154 refers to the speed setting values 164 and sets the rotation speed R3 to the speed Vc1 or the speed Vc3 according to the rotation speed R2 (step ST93). Accordingly, the drive control section 153 modifies the operation speed of the transport roller drive section 343 such that transport speed V2>transport speed V3.

Here, the measuring section 152 starts the count of a T2down timer (step ST94). The T2down timer is a timer which counts the time in which the second tension roller 812 moves from the position P86 to the position P87.

The measuring section 152 determines whether or not the second bottom sensor 316 detects the second tension roller 812 based on the detection value of the second bottom sensor 316 acquired by the detection control section 151 (step ST95). When the second bottom sensor 316 does not detect the second tension roller 812 (step ST95: NO), the measuring section 152 waits at step ST95.

When the second bottom sensor 316 detects the second tension roller 812 (step ST95: YES), the measuring section 152 stops the T2down timer and temporarily stores the count value of the T2down timer in the control section 150 (step ST96). In step ST96, the count value of the T2down timer is stored as a measurement value T2down(k). Here, "k" is a variable indicating an execution number of the counts of the T2down timer and the measuring section 152 adds 1 to the value of the execution number k every time the T2down timer starts a count.

The rotation control section 154 determines whether or not the value of the execution number k of the T2down timer reaches the setting number na (step ST97). When the execution number k reaches the setting number na (step ST97: YES), the rotation control section 154 transitions to step ST107. The processes of step ST107 onward will be described later.

When the execution number k does not reach the setting number na (step ST97: NO), the rotation control section 154 refers to the speed setting values 164 and sets the rotation speed R3 to the speed Vc2 or the speed Vc4 (step ST98). Accordingly, the drive control section 153 modifies the operation speed of the transport roller drive section 343 such that transport speed V2<transport speed V3.

The measuring section 152 determines whether or not the second bottom sensor 316 no longer detects the second tension roller 812 based on the detection value of the second bottom sensor 316 (step ST99). While the second bottom sensor 316 is detecting the second tension roller 812 (step ST99: NO), the measuring section 152 waits. When the second bottom sensor 316 no longer detects the second tension roller 812 (step ST99: YES), the measuring section 152 starts the count of the T2up timer (step ST100) and returns to step ST91. The T2up timer is a timer which counts the time in which the second tension roller 812 moves from the position P87 to the position P86.

Subsequently, the control section 150 executes steps ST91 to ST92.

When the measuring section 152 determines that the second top sensor 315 detects the second tension roller 812 (step ST91: YES) and determines that the count of the T2up timer is being executed (step ST92: YES), the measuring section 152 transitions to step ST101. In step ST101, the measuring section 152 stops the count of the T2up timer and stores the count value in the control section 150 (step ST101). In step ST101, the count value of the T2up timer is stored as T2up (m). Here, "m" is a variable indicating an execution number of the counts of the T2up timer and the measuring section 152 adds 1 to the value of the execution number m every time the T2up timer starts a count.

The rotation control section 154 determines whether or not the value of the execution number m of the T2up timer reaches the setting number na (step ST102). When the execution number m is yet to reach the setting number na (step ST102: NO), the rotation control section 154 transitions to step ST93.

When the execution number m reaches the setting number na (step ST102: YES), the rotation control section 154 calculates an average value My of T2up (m) stored in the control section 150 (step ST103). The average value My is the average of the time required for the movement of the second tension roller 812 when the operation of the second tension roller 812 moving from the position P87 to the position P86 is executed m times.

The rotation control section 154 compares the average value My to the first reference time S1 (step ST104) and transitions to step ST93 when the average value My is greater than or equal to the first reference time S1 (step ST104: NO).

When the average value My is smaller than the first reference time S1 (step ST104: YES), the rotation control section 154 modifies the values of the speeds Vc2 and Vc4 of the speed setting values 164 (step ST105). In step ST105, the rotation control section 154 executes the processes of Equations (3) and (4) below.

$$Vc2=Vc2-Vc2\times0.05 \quad (3)$$

$$Vc4=Vc4-Vc4\times0.05 \quad (4)$$

The processes of Equations (3) and (4) are processes of reducing the values of the speeds Vc2 and Vc4 by 5%. In step ST105, the rotation control section 154 may overwrite the values of the speed setting values 164 stored by the control section 150 and may temporarily update the values of the speeds Vc2 and Vc4 of the speed setting values 164 such that it is possible to restore the values of the speeds Vc2 and Vc4 to the pre-update values.

The rotation control section 154 resets the execution number m (step ST106) and transitions to step ST93.

According to the processes of steps ST103 to ST106, the rotation control section 154 lowers the speeds Vc2 and Vc4 in a case in which the average value My of the movement time when the second tension roller 812 moves from the position P87 to the position P86 is shorter than the first reference time S1. Accordingly, the difference between the transport speed V3 and the transport speed V2 when the rotation speed R3 of the pre-cutting transport section 88 is set to a high speed of Vc2 or Vc4 shrinks. Therefore, when transport speed V2<transport speed V3, there is an effect of lengthening the time in which the second tension roller 812 moves from the position P87 to the position P86. Therefore, it is possible to reduce the speed of the movement of the second tension roller 812 and stabilize the operation of the sheet manufacturing apparatus 100.

The time in which the second tension roller 812 moves between the second top sensor 315 and the second bottom sensor 316 being short means that the heated sheet SS2 is displaced at high speed in the second buffer portion 802. Since this state has great fluctuation in the tension applied to the heated sheet SS2, the state is not preferable from the perspective of stabilizing the manufacturing quality of the sheet S. Since the frequency at which the rotation control section 154 modifies the rotation speed R3 is high, this is not preferable since the operation of the sheet manufacturing apparatus 100 does not easily stabilize. In this case, it is possible to reduce the speed of the movement of the second tension roller 812 and stabilize the operation of the sheet manufacturing apparatus 100 through the rotation control section 154 modifying the speeds Vc2 and Vc4 serving as the setting value of the rotation speed R3.

The proportion by which to reduce the speeds Vc2 and Vc4 in the process of step ST105 is stored contained in the basic setting data 161 or the measurement setting data 162, for example. The proportion is arbitrary and "5%" depicted in FIG. 7 is merely an example. It is preferable that the proportion be smaller than the difference between the speeds Vc2 and Vc4 and the speeds Vc1 and Vc3, and it is possible to set the proportion to less than or equal to 10%, for example.

The rotation control section 154 also executes a similar process for the speeds Vc1 and Vc3.

The rotation control section 154 determines whether or not the value of the execution number k of the T2down timer reaches the setting number na (step ST97), and when the execution number k reaches the setting number na (step ST98: YES), calculates an average value Me of T2down(k) stored in the control section 150 (step ST107). The average value Me is the average of the time required for the movement of the second tension roller 812 when the operation of the second tension roller 812 moving from the position P86 to the position P87 is executed k times.

The rotation control section 154 compares the average value Me to the first reference time S1 (step ST108) and transitions to step ST98 when the average value Me is greater than or equal to the first reference time S1 (step ST108: NO).

When the average value Me is smaller than the first reference time S1 (step ST108: YES), the rotation control section 154 modifies the values of Vc1 and Vc3 of the speed setting values 164 (step ST109). In step ST105, the rotation control section 154 executes the processes of Equations (5) and (6) below.

$$Vc1=Vc1+Vc1\times0.05 \quad (5)$$

$$Vc3=Vc3+Vc3\times0.05 \quad (6)$$

The processes of Equations (5) and (6) are processes of increasing the values of Vc1 and Vc3 by 5%. In step ST109, the rotation control section 154 may overwrite the values of the speed setting values 164 stored by the control section 150 and may temporarily update the values of Vc1 and Vc3 of the speed setting values 164 such that it is possible to restore the values of the speeds Vc1 and Vc3 to the pre-update values.

The rotation control section 154 resets the execution number k (step ST110) and transitions to step ST98.

According to the processes of steps ST107 to ST109, the rotation control section 154 increases the speeds Vc1 and Vc3 in a case in which the average value Me of the movement time when the second tension roller 812 moves from the position P86 to the position P87 is shorter than the first reference time S1. Accordingly, the difference between the transport speed V3 and the transport speed V2 when the rotation speed R3 of the heating rollers 86 is set to the low speed of Vc1 or Vc3 shrinks. Therefore, when transport speed V2>transport speed V3, there is an effect of lengthening the time in which the second tension roller 812 moves from the position P86 to the position P87. Therefore, it is possible to reduce the speed of the movement of the second tension roller 812 and stabilize the operation of the sheet manufacturing apparatus 100.

The proportion by which to reduce the speeds Vc1 and Vc3 in the process of step ST109 is stored contained in the basic setting data 161 or the measurement setting data 162, for example. The proportion is arbitrary and "5%" depicted in FIG. 7 is merely an example. It is preferable that the proportion be smaller than the difference between the speeds Vc2 and Vc4 and the speeds Vc1 and Vc3, and it is possible to set the proportion to less than or equal to 10%, for example.

In step ST97 and step ST102, the operation of comparing the execution numbers k and m to the common setting number na is an example and the execution number k and the execution number m may be compared to different setting values. The number of setting numbers na is arbitrary.

In step ST104 and step ST108, the operation of comparing the average value My and the average value Me to the common first reference time S1 is an example and the average value My and the average value Me may be compared to different reference times. The value of the first reference time S1 is arbitrary.

In the processes of FIG. 10, there is no specific intention in using the same setting number na and the first reference time S1 as in FIG. 7. A configuration may be adopted in which the measurement setting data 162 contains a different setting number from the setting number na and a different reference time from the first reference time S1 as the setting values relating to the setting of the rotation speed R3.

The modification may be performed on only one of the speed Vc2 and the speed Vc4 in step ST105, and similarly, the modification may be performed on only one of the speed Vc1 and the speed Vc3 in step ST109.

As described above, in the third embodiment, the present disclosure is applied to the second buffer portion 802. In this case, the sheet manufacturing apparatus 100 serving as the transporting apparatus is provided with the heating rollers 86 which transport the web-like or sheet-like transport target object FM and the transport rollers 89 which are disposed downstream of the heating rollers 86 in the transport path FW. The sheet manufacturing apparatus 100 is provided with the second bottom sensor 316 disposed between the heating rollers 86 and the transport rollers 89 in the transport path FW and provided on one side in of the transport path FW and the second top sensor 315 provided on the other side of the transport path FW. The sheet manufacturing apparatus 100 is provided with the measuring section 152 which measures the time from when the transport target object FM is detected by the second bottom sensor 316 until the transport target object FM is detected by the second top sensor 315. The sheet manufacturing apparatus 100 is provided with the rotation control section 154 which modifies the rotation speed of the transport rollers 89 when the time measured by the measuring section 152 is shorter than the first reference time S1.

Expressed in different terms, the second bottom sensor 316 and the second top sensor 315 are disposed between the heating rollers 86 and the transport rollers 89 in the transport path FW of the sheet manufacturing apparatus 100 and are disposed to face each other in a direction intersecting the transport path FW.

The sheet manufacturing apparatus 100 executes a transporting method including a first step and a second step. In the first step, a time from when the transport target object FM is detected by the second bottom sensor 316 until the transport target object FM is detected by the second top sensor 315 is measured. In the second step, the rotation speed of the transport rollers 89 is modified when the time measured in the first step is shorter than the first reference time S1.

The sheet manufacturing apparatus 100 serving as the fibrous feedstock recycling apparatus is provided with the forming section 101 which forms the transport target object FM serving as the processing target object from the feedstock MA containing the fibers. The sheet manufacturing apparatus 100 includes the cutting section 90 serving as the processing section which processes the transport target object FM. The sheet manufacturing apparatus 100 also includes the pre-cutting transport section 88 which transports the processing target object from the forming section 101 to the cutting section 90. The sheet manufacturing apparatus 100 is provided with the heating rollers 86 which transport the transport target object FM and the transport rollers 89 which are disposed downstream of the heating rollers 86 in the transport path FW. The sheet manufacturing apparatus 100 is provided with the second bottom sensor 316 disposed between the heating rollers 86 and the transport rollers 89 in the transport path FW and provided on one side in of the transport path FW and the second top sensor 315 provided on the other side of the transport path FW. The sheet manufacturing apparatus 100 is provided with the measuring section 152 which measures the time from when the transport target object FM is detected by the second bottom sensor 316 until the transport target object FM is detected by the second top sensor 315. The sheet manufacturing apparatus 100 is provided with the rotation control section 154 which modifies the rotation speed of the transport rollers 89 when the time measured by the measuring section 152 is shorter than the first reference time S1.

In the second buffer portion 802 described in the third embodiment, the first roller is the heating rollers 86, the second roller is the transport rollers 89, and the second top sensor 315 and the second bottom sensor 316 are disposed between the heating rollers 86 and the transport rollers 89. The transport target object FM is the heated sheet SS2. The molding section 80 and the pre-cutting transport section 88 serve as the transport section to transport the heated sheet SS2. The second bottom sensor 316 corresponds to the first detection section and the first sensor and the second top sensor 315 corresponds to the second detection section and the second sensor. The second tension roller 812 corresponds to the moving member.

Accordingly, when the transport target object FM is transported by the heating rollers 86 and the transport rollers 89, it is possible to adjust the speed difference between the transport speed V2 and the transport speed V3. Accordingly, for example, it is possible to adjust the speed difference between the transport speed V2 and the transport speed V3 such that the speed of the displacement of the transport target object FM in the second buffer portion 802 falls within an appropriate range and it is possible to stabilize the transport target object FM during transport.

In the sheet manufacturing apparatus 100, the second bottom sensor 316 is disposed to one side of the transport path FW in the vertical direction and the second top sensor 315 is installed on the opposite side from the second bottom sensor 316 in the transport path FW.

The sheet manufacturing apparatus 100 is provided with the second tension roller 812 which is disposed between the heating rollers 86 and the transport rollers 89 in the transport path FW and moves in response to the displacement of the transport target object FM. The first detection section is the second bottom sensor 316 which detects the second tension roller 812. The second detection section is the second top sensor 315 which detects the second tension roller 812. The second top sensor 315 and the second bottom sensor 316 detect the transport target object FM by detecting the second tension roller 812. Accordingly, it is possible to reliably detect the position of the transport target object FM at high precision.

When the second tension roller 812 which is the moving member is configured to come into contact with the transport target object FM and moves in response to the displacement of the transport target object FM, it is possible to suppress the slack of the transport target object FM using the second tension roller 812 and to more stably transport the transport target object FM.

The rotation control section 154 executes stepwise control in which the speed of the transport rollers 89 is modified in a stepwise manner. For example, the rotation speed R3 of the transport rollers 89 is set to one of the speeds Vc1, Vc2, Vc3, and Vc4 set in the speed setting values 164. The rotation control section 154 modifies the rotation speed of the transport rollers 89 by a smaller change amount than the stepwise control when the time measured by the measuring section 152 is shorter than the first reference time S1. For example, the rotation control section 154 changes each of the speeds Vc1 and Vc3 and the speeds Vc2 and Vc4 by 5%.

Accordingly, it is possible to adjust the speed difference between the transport speed V2 and the transport speed V3 by a smaller change amount than the stepwise control when performing the stepwise control in which the magnitude relationship between the transport speed V2 and the transport speed V3 is switched in a stepwise manner and the transport target object FM is transported. It is possible to still further stabilize the transport target object FM by making minute adjustments to the speed difference between the transport speed V2 and the transport speed V3.

The second bottom sensor 316 is disposed so as to correspond to the position of the transport target object FM when the length of the transport target object FM between the heating rollers 86 and the transport rollers 89 is a predetermined length. The second top sensor 315 is disposed so as to correspond to the position of the transport target object FM when the length of the transport target object FM between the heating rollers 86 and the transport rollers 89 is a predetermined length. The position of the transport target object FM is the position of the transport target object FM when the second tension roller 812 is at the position P87, for example. The second top sensor 315 is disposed so as to correspond to the position of the transport target object FM when the length of the transport target object FM between the heating rollers 86 and the transport rollers 89 is a predetermined length. The position of the transport target object FM is a position shifted further to the D side than the position P85 and is the position of the transport target object FM when the second tension roller 812 is at the position P86. The rotation control section 154 sets the rotation speed of the transport rollers 89 to a first speed when the transport target object FM is detected by the second bottom sensor 316. The rotation control section 154 sets the rotation speed of the transport rollers 89 to a second speed which is a lower speed than the first speed when the transport target object FM is detected by the second top sensor 315. The first speed is the speed Vc2 and/or the speed Vc4, for example, and the second speed is the speed Vc1 and/or the speed Vc3, for example. The rotation control section 154 modifies one or both of the first speed and the second speed when the time T1up (m) measured by the measuring section 152 is shorter than the first reference time S1. In the embodiment, a process of reducing the speeds Vc2 and Vc4 which are the first speed by 5% in step ST105 and a process of increasing the speeds Vc1 and Vc3 which are the second speed by 5% in step ST109 are performed.

In this configuration, the rotation control section 154 modifies the rotation speed R3 to the first speed such that the transport target object FM is shortened when the length of the transport target object FM in the second buffer portion 802 is a predetermined length. When the transport target object FM is shorter than the predetermined length, the rotation control section 154 performs control in which the rotation speed R3 is modified to the second speed such that the transport target object FM is lengthened. The sheet manufacturing apparatus 100 prevents the application of excessive tension to the transport target object FM and excessive slack in the transport target object FM by causing the length of the transport target object FM to fluctuate. Since the rotation control section 154 modifies the speeds Vc1, Vc2, Vc3, and Vc4 when the time T1up (m) measured by the measuring section 152 is shorter than the first reference time S1, it is possible to keep the speed of the fluctuation in the length of the transport target object FM within an appropriate range, for example. Accordingly, it is possible to still further stabilize the transport target object FM.

Restrictions may be put on the cumulative change amount of the speeds Vc2 and Vc4 when step ST105 is executed a plurality of times. For example, when step ST105 is executed, a restriction may be put on the cumulative change amount of the speeds Vc2 and Vc4 so as to not exceed a range of ±10% of the speeds Vc2 and Vc4 before executing the operations of FIG. 7. In this case, the rotation control section 154 modifies the speeds Vc2 and Vc4 within a range not departing from a range of ±10% from the initial values of the speeds Vc2 and Vc4 before executing the operations of FIG. 7. Similarly, restrictions may be put on the cumulative change amount of the speeds Vc1 and Vc3 when step ST109 is executed a plurality of times. For example, when step ST109 is executed, a restriction may be put on the cumulative change amount of the speeds Vc1 and Vc3 so as to not exceed a range of ±10% of the speeds Vc1 and Vc3 before executing the operations of FIG. 7. In this case, the rotation control section 154 modifies the speeds Vc1 and Vc3 within a range not departing from a range of ±10% from the initial values of the speeds Vc1 and Vc3 before executing the operations of FIG. 7. The restrictions of the change amount between the speeds Vc1 and Vc3 and the speeds Vc2 and Vc4 may be defined using the speed difference between the transport speed V2 and the transport speed V3. In other words, the values of the speeds Vc2 and Vc4 may be restricted such that the relationship of transport speed V2>transport speed V3 is maintained or such that the transport speed V3 becomes a higher speed than the transport speed V2 by greater than or equal to 10%. Similarly, the values of the speeds Vc1 and Vc3 may be restricted such that the relationship of transport speed V2<transport speed V3 is maintained or such that the transport speed V3 becomes a lower speed than the transport speed V2 by greater than or equal to 10%.

The measurement of the time T1up (m) required for the operations from when the transport target object FM is detected by the second bottom sensor 316 until the transport target object FM is detected by the second top sensor 315 is repeatedly executed by the measuring section 152 until m=setting number na. The rotation control section 154 compares the average value Mu of the measured times T1up (m) by the measuring section 152 to the first reference time S1. In the embodiment, the setting number na is greater than or equal to 2.

Accordingly, it is possible to suppress the frequency of the modification of the rotation speed R3 and it is possible to prevent destabilization of the transporting of the transport target object FM caused by fluctuations in the rotation speed R3 and to more stably transport the transport target object FM.

4. Fourth Embodiment

The embodiments described above are merely specific modes which embody the present disclosure, do not limit the present disclosure, and as indicated hereinafter, for example, may be embodied in various modes within a scope not departing from the gist of the present disclosure.

In the third embodiment described above, an example is used in which the control described in FIG. 7 is executed in relation to the rotation speed R2 and the control described in FIG. 10 is executed in relation to the rotation speed R3. This is merely an example and similar control to the processes illustrated in FIG. 8 may be performed in relation to the rotation speed R2, for example.

In the embodiments, although a configuration is exemplified in which the transport target object FM transported by the molding section 80 and the pre-cutting transport section 88 is formed from the feedstock MA by the forming section 101, the present disclosure is not limited thereto. For example, the present disclosure may be applied to a transporting apparatus provided with transport rollers which transport a web-like or sheet-like transport target object. For example, the present disclosure may be applied to an apparatus provided with transport rollers which transport paper, fabric, non-woven fabric, sheets of synthetic resin, or the like.

The sheet manufacturing apparatus 100 is not limited to manufacturing the sheet S, and may be configured to manufacture a board-like or web-like manufactured product configured by hard sheets or layered sheets. The manufactured product is not limited to paper and may be a non-woven fabric. The properties of the sheet S are not particularly limited, and the sheet S may be paper usable as recording paper (for example, so-called PPC paper sheets) with the purpose of writing or printing, and may be wallpaper, wrapping paper, colored paper, drawing paper, Bristol board, or the like. When the sheet S is a non-woven fabric, in addition to a general non-woven fabric, fiber board, tissue paper, kitchen paper, a cleaner, a filter, a liquid absorbent material, a sound absorber, a buffer material, a mat, or the like may be used.

In the embodiment, as the transporting apparatus and the fibrous feedstock recycling apparatus of the present disclosure, a description is given of the sheet manufacturing apparatus 100 of a dry system in which a material is obtained by defibrating the feedstock in a gas and the sheet S is manufactured using the material and a resin. The application target of the present disclosure is not limited thereto, and the present disclosure may also be applied to a so-called sheet manufacturing apparatus of a wet system which causes a feedstock containing fibers to dissolve or float in a medium such as water and processes the feedstock into sheets. It is also possible to apply the present disclosure to a sheet manufacturing apparatus of an electrostatic system in which a material containing fibers defibrated in a gas is attracted to a surface of a drum using static electricity and the feedstock attracted to the drum is processed into sheets.

The entire disclosure of Japanese Patent Application No: 2018-207919, filed Nov. 5, 2018 is expressly incorporated by reference herein.

What is claimed is:

1. A transporting apparatus comprising:

a first roller that transports a web-like or sheet-like transport target object; and a second roller disposed downstream of the first roller in a transport path of the transport target object, the second roller being configured to transport the transport target object;

a first sensor that is disposed between the first roller and the second roller along the transport path;

a second sensor disposed adjacent to the second roller along the transport path;

a controller configured to:

measure a time from when the transport target object is detected by the first sensor until the transport target object is detected by the second sensor; and modify a rotation speed of the second roller when the measured time is shorter than a predetermined first reference time.

2. The transporting apparatus according to claim 1, wherein with respect to a vertical direction, the first sensor is disposed on one side of the transport path and the second sensor is installed on an opposite side of the transport path from the first sensor.

3. The transporting apparatus according to claim 1, further comprising:

a first tension roller disposed between the first roller and the second roller in the transport path, the tension roller being configured to move in response to displacement of the transport target object, wherein the first sensor is configured to detect movement of the first tension roller to a first position and the second sensor configured to detect movement of a second tension roller to a second position; and the sensor and the second sensor are configured to detect a position of the transport target object based on the movement of the first tension roller and the second tension roller.

4. The transporting apparatus according to claim 1, wherein the controller is configured to execute stepwise control for modifying, in a stepwise manner, the rotation speed of the second roller and modifies the rotation speed of the second roller by a smaller change amount than in the stepwise control when the time measured is shorter than the predetermined first reference time.

5. The transporting apparatus according to claim 1, wherein the first sensor is disposed at a position of the transport target object when a length of the transport target object between the first roller and the second roller is a predetermined length, the second sensor is disposed at a position of the transport target object when the length of the transport target object between the first roller and the second roller is shorter than the predetermined length, the controller is configured to set the rotation speed of the second roller to a first speed when the position the transport target object is detected by the first sensor and configured to set the rotation speed of the second roller to a second speed that is a lower speed than the first speed when the position transport target object is detected by the second sensor, and the controller is configured to modify one or both of the first speed and the second speed when the time measured is shorter than the predetermined first reference time.

6. The transporting apparatus according to claim 1, wherein:

the controller is configured to:

repeatedly measure a time required for an operation from when the transport target object is detected by the first sensor until the transport target object is detected by the second sensor, compare an average value of a set number of measured times to the predetermined first reference time, and the set number is greater than or equal to 2.

7. The transporting apparatus according to claim 6, wherein the controller is configured to modify the set number.

8. The transporting apparatus according to claim 7, wherein the controller is configured to modify the set number based on a number of times an operation of detecting the transport target object by the second sensor after the transport target object is detected by the first sensor is performed in a predetermined second reference time.

9. The transporting apparatus according to claim 1, wherein the first roller is a pressurizing roller configured to pressurize the transport target object.

10. A fibrous feedstock recycling apparatus comprising:

a forming section configured to form a web-like or sheet-like processing target object from a feedstock containing fibers;

a processing section configured to process the processing target object; and a transport section configured to transport the processing target object from the forming section to the processing section, wherein the transport section includes:

a first roller that transports the processing target object and a second roller configured to transport the processing target object and being disposed downstream of the first roller in a transport path of the processing target object, a first sensor and that is disposed between the first roller and the second roller in the transport path of the processing target object, a second sensor disposed adjacent to the second roller in the transport path;

a controller configured to:

measure a time from when a presence of the processing target object is detected by the first sensor until the presence the processing target object is detected by the second sensor; and modify a rotation speed of the second roller when the time measured is shorter than a predetermined first reference time.

11. The fibrous feedstock recycling apparatus according to claim 10, wherein the first roller or the second roller is a pressurizing roller that pressurizes the processing target object, and the roller that is not the pressurizing roller among the first roller and the second roller is a heating roller that heats the processing target object.

12. A transporting method of transporting a web-like or sheet-like transport target object using a first roller that transports the transport target object and a second roller disposed downstream of the first roller in a transport path of the transport target object in which a first sensor is disposed between the first roller and the second roller and a second sensor is disposed adjacent to the second roller along the transport path, the method comprising:

a first step of measuring a time from when a presence of the transport target object is detected by the first sensor until the presence of the transport target object is detected by the second sensor; and a second step of modifying a rotation speed of the second roller when the time measured in the first step is shorter than a predetermined first reference time.

* * * * *